US011217094B2

(12) United States Patent
Zalila-Wenkstern et al.

(10) Patent No.: US 11,217,094 B2
(45) Date of Patent: Jan. 4, 2022

(54) COLLABORATIVE DISTRIBUTED AGENT-BASED TRAFFIC LIGHT SYSTEM AND METHOD OF USE

(71) Applicant: Board of Regents, The University of Texas System, Austin, TX (US)

(72) Inventors: Rym Zalila-Wenkstern, Plano, TX (US); Behnam Torabi, Dallas, TX (US)

(73) Assignee: Board of Regents, The University of Texas System, Austin, TX (US)

( * ) Notice: Subject to any disclaimer, the term of this patent is extended or adjusted under 35 U.S.C. 154(b) by 0 days.

(21) Appl. No.: 16/946,531

(22) Filed: Jun. 25, 2020

(65) Prior Publication Data

US 2020/0410855 A1 Dec. 31, 2020

Related U.S. Application Data

(60) Provisional application No. 62/866,586, filed on Jun. 25, 2019, provisional application No. 62/870,634, filed on Jul. 3, 2019.

(51) Int. Cl.

| | |
|---|---|
| ***G08G 1/08*** | (2006.01) |
| ***G08G 1/082*** | (2006.01) |
| ***G08G 1/087*** | (2006.01) |
| ***G08G 1/083*** | (2006.01) |

(52) U.S. Cl.

CPC ..... *G08G 1/082* (2013.01); *G08G 1/08* (2013.01); *G08G 1/083* (2013.01); *G08G 1/087* (2013.01)

(58) Field of Classification Search

CPC ..... G08G 1/07; G08G 1/08; G08G 1/081; G08G 1/082; G08G 1/083

See application file for complete search history.

(56) References Cited

U.S. PATENT DOCUMENTS

| | | | | |
|---|---|---|---|---|
| 9,159,229 | B2 | 10/2015 | Xie et al. | |
| 9,818,297 | B2 | 11/2017 | El-Tantawy et al. | |
| 10,083,607 | B2 | 9/2018 | Ginsberg et al. | |
| 2013/0176146 | A1* | 7/2013 | Dusparic | G08G 1/07 340/907 |
| 2015/0102945 | A1* | 4/2015 | El-Tantawy | G08G 1/081 340/909 |
| 2018/0286228 | A1* | 10/2018 | Xu | G08G 1/0112 |

OTHER PUBLICATIONS

Balaji, et al. (Nov. 2010). Multi-Agent System in Urban Traffic Signal Control. IEEE Computational Intelligence Magazine.

(Continued)

*Primary Examiner* — Andrew W Bee

(74) *Attorney, Agent, or Firm* — Schultz & Associates, P.C.

(57) ABSTRACT

In this disclosure, collaborative multi-agent-based TST is presented with dedicated intersection controllers that include software agents which read local and remote detection systems and then collaboratively optimize signal timing phases by considering the feedback of all controller agents that may be affected by a change. The disclosure also presents an augmented system which considers network input from handheld remote devices to update certain traffic light phase information and adapt to emerging emergency situations.

6 Claims, 26 Drawing Sheets

(56) References Cited

OTHER PUBLICATIONS

Chu, et al. (May 2017). Traffic Signal Control by Distributed Reinforcement Learning with Min-sum Communication. 2017 American Control Conference.
Chun-gui, et al. (2010). Approximation Dynamic Programming for Multi-intersections Traffic Signal Intelligent Control. International Conference on Datural Computation (ICNC) 2010.
Liu, et al. (2014). Cooperative Multi-agent Traffic Signal Control System Using Fast Gradient-descent Function Approximation For V2I Networks. IEEE ICC—Mobile and Wireless Networking Symposium.
Moore, Dave (Feb. 27, 2019). Go Time: Traffic-Control Signals Cut Stoplight Wait by 40% in Richardson. UT Dallas Computer Science Department, https://cs.utdallas.edu/self-syncing-stoplight-technology-developed-by-ut-dallas-cs-professor-can-be-used-in-any-city-that-deploys-programmable-traffic-controllers-with-internet-access/ (last accessed May 28, 2019).
Peters, Chelsea (Apr. 19, 2019). Multiyear overhaul to traffic infrastructure system underway in Richardson. Community Impact Newspaper. https://communityimpact.com/dallas-fort-worth/richardson/city-county/ (last accessed May 28, 2019).
Torabi, et al. (Jan. 13, 2020). A collaborative agent-based traffic signal system for highly dynamic traffic conditions. Journal of Autonomous Agents and Multi-Agent Systems (JAAMAS), 34(1):1-24, 2020.
Torabi, et al. (Jul. 10, 2018). A Multi-Hop Agent-Based Traffic Signal Timing System for the City of Richardson. International Conference on Autonomous Agent and Multiagent Systems (AAMAS) 2018.
Torabi, et al. (Jun. 20, 2018). MATISSE 3.0: A Large-Scale Multi-agent Simulation System for Intelligent Transportation Systems. International Conference on Practical Applications of Agents and Multi-Agent Systems (PAAMS) 2018.
Torabi, et al. (May 9, 2020). Deployment of a Multi-Agent Traffic Signal Timing System. AAMAS 2020 International Conference on Autonomous Agents and Multiagent Systems.
Torabi, et al. (May 9, 2020). DALI: An Agent-Plug-In System to "Smartify" Conventional Traffic Control Systems. AAMAS 2020 International Conference on Autonomous Agents and Multiagent Systems.
Torabi, et al. (Nov. 4, 2018). A Collaborative Agent-Based Traffic Signal System For Highly Dynamic Traffic Conditions. IEEE International Conference on Intelligent Transportation Systems (ITSC) 2018.
Torabi, et al. (Nov. 4, 2018). An Agent-Based Micro-Simulator for ITS. IEEE International Conference on Intelligent Transportation Systems (ITSC) 2018.
Torabi, et al. (Oct. 18, 2017). Agent-based decentralized traffic signal timing. International Symposium on Distributed Simulation and Real Time Applications (DS-RT) 2017.
Torabi, et al. (Sep. 16, 2018). A Self-Adaptive Collaborative Multi-Agent based Traffic Signal Timing System. IEEE International Smart Cities Conference (ISC2) 2018.
Van Katwijk, et al. (Oct. 2009). Multi-agent control of traffic networks: Algorithm and case study. IEEE International Conference on Intelligent Transportation Systems (ITSC) 2009.
Vilarinho, et al. (2016). Design of a Multiagent System for Real-time Traffic Control. IEEE Intelligent Systems: Intelligent Transportation Systems.
Wu, et al. (2018). Distributed Weighted Balanced Control of Traffic Signals for Urban Traffic Congestion. IEEE Transactions on Intelligent Transportation Systems.
Xu, et al. (May 2018). Optimizing multi-agent based urban traffic signal control system. Journal of Intelligent Transportation Systems Technology Planning and Operations.
Torabi, et al. (Jul. 17, 2019). DALI: A Distributive, Collaborative Agent-Based Traffic Control System. MAVS LAB—Department of Computer Science of the University of Texas at Dallas presentation for the City of Dallas.

* cited by examiner

COLLABORATIVE DISTRIBUTED AGENT-BASED TRAFFIC LIGHT SYSTEM AND METHOD OF USE

CROSS-REFERENCE TO RELATED APPLICATIONS

This application claims priority benefit from U.S. Provisional Application No. 62/866,586 filed Jun. 25, 2019. This application claims priority benefit from U.S. Provisional Application No. 62/870,634 filed on Jul. 3, 2019. The patent applications identified above are incorporated here by reference in their entirety to provide continuity of disclosure.

FIELD OF THE INVENTION

This disclosure is directed to the technology field of traffic signal timing (TST) systems. A preferred embodiment of this disclosure is directed to collaborative distributed agent-based traffic lights (DALI).

BACKGROUND OF THE INVENTION

In the most basic terms, traffic signal timing involves determining the sequence of operation and assigning green time to each approach at an intersection while considering time for pedestrians and other users as well. Cycle lengths, phases, splits, peak hour trends, pre-timed and actuated signals, optimization, coordination, and communications between lights are all considerations in traffic signal timing.

A cycle length is the amount of time required to display all traffic light phases for each direction of an intersection before returning to the starting point, or the first phase of the cycle. Cycle lengths are based on traffic volumes and work best within a certain range depending on the conditions of the intersection. The goal of signal timing is to find an optimum cycle length for the most efficiency. Typical cycle lengths may range from one minute to three minutes. A split determines how much time each movement gets in a cycle. The split includes the green time and the clearance interval, or the time to clear the intersection, which includes the yellow and red lights. Clearance interval times are calculated based on speed limit, intersection widths, intersection grades, perception or start-up time, and acceleration rates. Clearance intervals are often referred as the change interval, when changing from one signal phase to the next. The clearance time in that sequence is also referred to as "loss time" due to vehicles coming to a stop or starting-up and the time that no vehicles are moving through the intersection.

Pre-timed signals are based on observed traffic volumes and trends and do not change based on traffic volume. Such signals are common in downtown grid locations with closely located intersections and one-way streets or where it may not be feasible to maintain inductance detection loops for each signal location.

Actuated signals can be semi-actuated or fully actuated. In the case of semi-actuated timings, less than all approaches include inductance detection loops. Fully actuated signals rely inductance loop detection at all approaches. The pre-timed signals have preset timing plans that vary during different times of the day. Fully actuated signals have minimum and maximum ranges for light phases based on traffic volume.

The two most common types of intersections are isolated intersections and system intersections. Isolated intersections are separated from other signalized intersections and operate independently. System intersections are interconnected. Timing changes at one intersection effect the other intersections.

Signal system corridors are specialized routes in a set of system intersections. Signal system corridors are timed based on a time of day basis for each associated peak period. The most common peak periods are the AM, PM and midday. Typically, these peak periods are driven by traffic patterns or daily commutes by direction. AM and PM peaks may be associated with "inbound" or "outbound" traffic patterns. Midday traffic patterns are most often balanced by direction.

Vehicle detection systems are widely used to supplement signal timing systems. Examples of vehicle detection systems include inductive loop detectors, radar, sub pavement electromagnetic pucks, and video cameras. Inductance loops are often placed in saw cuts in the pavement and run back to the traffic signal cabinet. A detection card produces a magnetic field that detects when a vehicle is present over the loop. Radar detection and video detection are also widely used. These systems rely on electromagnetic reflection to detect the presence of a vehicle.

The traffic lights are typically operated by a dedicated traffic signal controller located at or near the physical intersection. The dedicated controller collects information from the detection system, decides how to respond, and sends appropriate activation signals to the traffic lights.

The dedicated controllers are often connected via fiber optics, copper wire, or wireless networks to local traffic control centers where they are monitored and controlled remotely. Through remote connections, the traffic control center can communicate directly to controllers to make changes to the traffic signal operation.

Modern Traffic Signal Timing systems ("TSTs") rely on the detection of traffic conditions in real-time to determine effective signal settings. Generally, TSTs define traffic signal planning as an optimization problem where solutions are timing plans which meet objectives such as delay and stop minimization.

In the prior art, networked TSTs are known to approach the traffic signal timing optimization problem at the network level. These TSTs are fully centralized and, although reliable and robust, do not perform well in highly dynamic traffic conditions. Other prior art TSTs find optimal solutions only for isolated intersections. These systems make use of a variety of optimization techniques. But, one drawback of such isolated TSTs is the lack of interaction between intersection controllers which leads to sub-optimal solutions at the traffic system-level. Still other prior art TSTs solve the optimization problem for a subset of intersections. But, these systems generally limit coordination between controllers to only neighboring intersections.

In this disclosure, collaborative multi-agent-based TST is presented with dedicated intersection controllers that include software agents which read local and remote detection systems and then collaboratively optimize signal timing phases by considering the feedback of all controller agents that may be affected by a change.

The disclosure also presents an augmented system which considers network input from handheld remote devices to update certain traffic light phase information and adapt to emerging emergency situations.

DETAILED DESCRIPTION OF THE INVENTION

Figure 1:
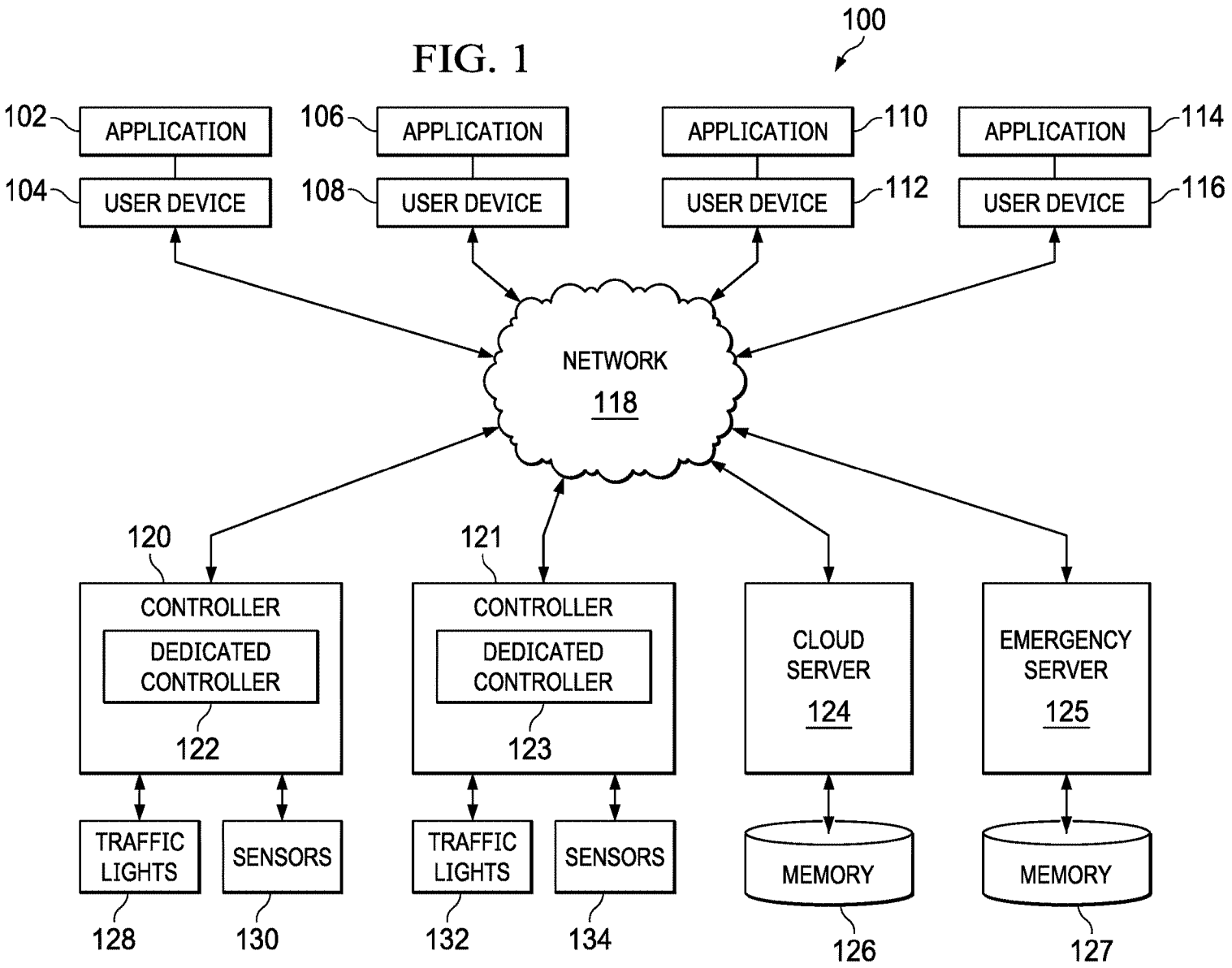
FIG. 1 is an architecture diagram showing a preferred network of collaborative distributed agent-based traffic lights.

Referring then to FIG. 1, system 100 will be described. The preferred system includes a plurality of user devices 104, 108, 112 and 116. Applications 102, 106, 110, 114 are separate instances of an application program installed on each of user devices 104, 108, 112, 116. The number of user devices shown is exemplary and can vary. In the preferred embodiment, the user devices are smart phones, tablet computers, or onboard vehicle computers, with GPS and cellular data capabilities.

User devices 104, 108, 112 and 116 are connected to cloud server 124, emergency server 125, and controllers 120 and 121 through wide area network 118. Cloud server 124 is operatively dedicated to memory 126, which contains maps of road networks and intersections. Cloud server 124 is linked to the user devices by an application programming interface (API) with third-party application programs, such as Google Maps, or Waze. Emergency server 125 is operatively connected to memory 127, which contains emergency dispatch information such as a list of valid emergency codes, preset emergency corridor routes, emergency vehicle ID numbers, dispatch hubs and emergency vehicle locations.

Controllers 120 and 121 are dedicated microcomputers each having local memory and appropriate network adapters. In a preferred embodiment, each of the controllers is an Intelight Microcontroller Model No. 2070 XC3, available from Q-Free America of Carlsbad, Calif. The 2070 X3C meets and exceeds the current ATC, CalTrans and NTCIP standards, providing an open-architecture hardware platform. The X3C runs Linux on an ATC-compliant motherboard offering multi-thread capabilities. The XC3 ports provide front-facing access for Ethernet, USB and serial connections. The controller provides a touch screen input panel and is used for software configuration, as will be further described. The number of controllers shown is exemplary. In other embodiments, the number of controllers can reach many thousand.

Controllers 120 and 121 are operatively connected to intersection traffic lights 128 and 132 and sensors 130 and 134. Traffic lights 128 and 132 are preferably sets of red/green/yellow signals at crossing points of each intersection. Of course, other traffic light configurations are possible. Sensors 130 and 134 can be any number of sensor types for sensing the presence of vehicles, such as automobiles, trucks, motorcycles, and public transit, bicycles or pedestrians, at the intersection where the controller is installed. Each of the controllers is located at a predefined set of latitude and longitude coordinates. Each of the controllers is in direct communication with the other controllers, user devices and servers through the wide area network.

Controllers 120 and 121 are programmed with program dedicated controllers 122 and 123, respectively, which monitor various inputs from the sensors and input devices (such as pedestrian crossing buttons) at the intersection and generate outputs for the traffic and crosswalk signals.

Figure 2A:
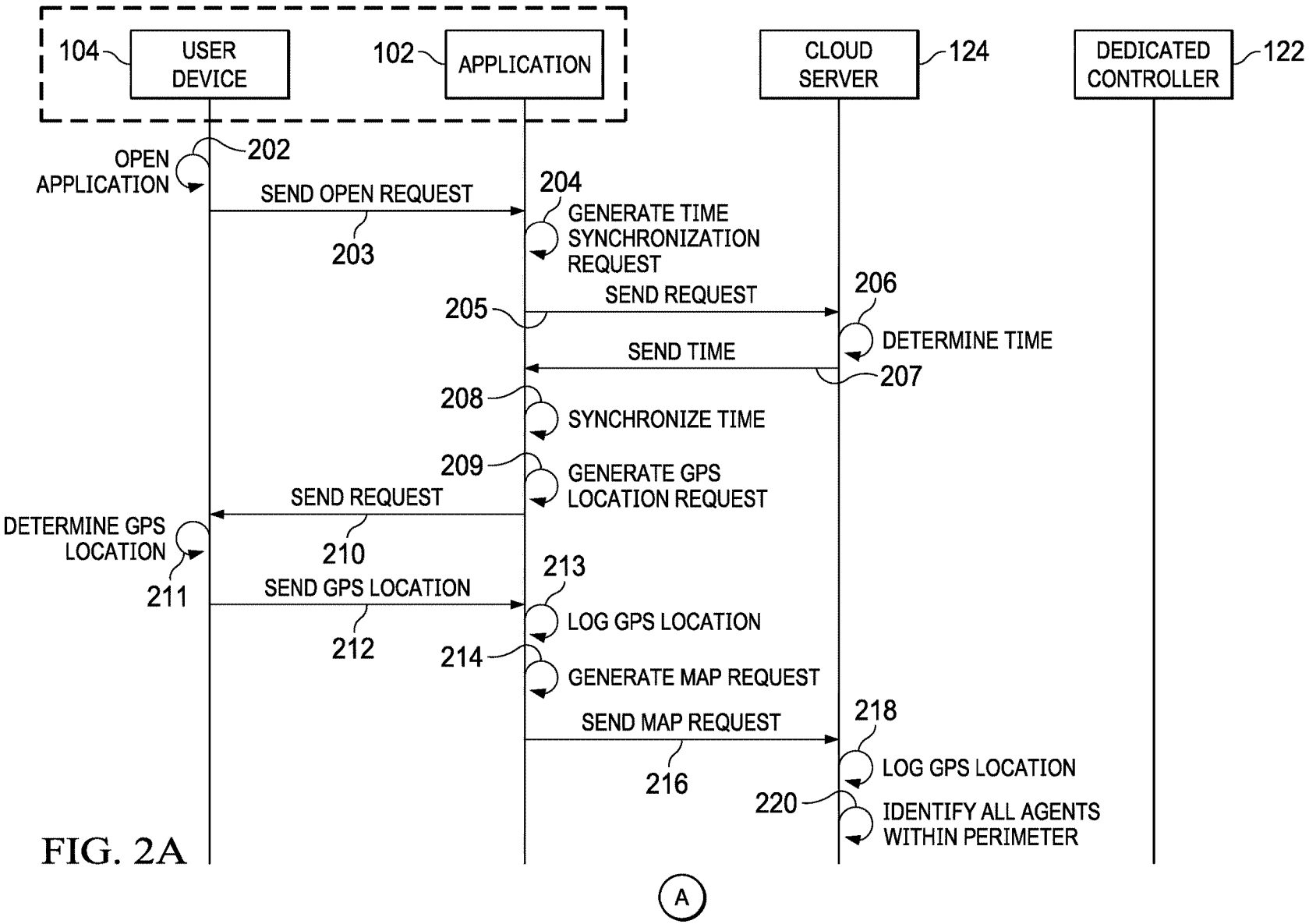
FIGS. 2A and 2B are a sequence diagram for a preferred embodiment of the method for mode selection in a collaborative distributed agent-based traffic light monitoring and alerting system.
Figure 2B:
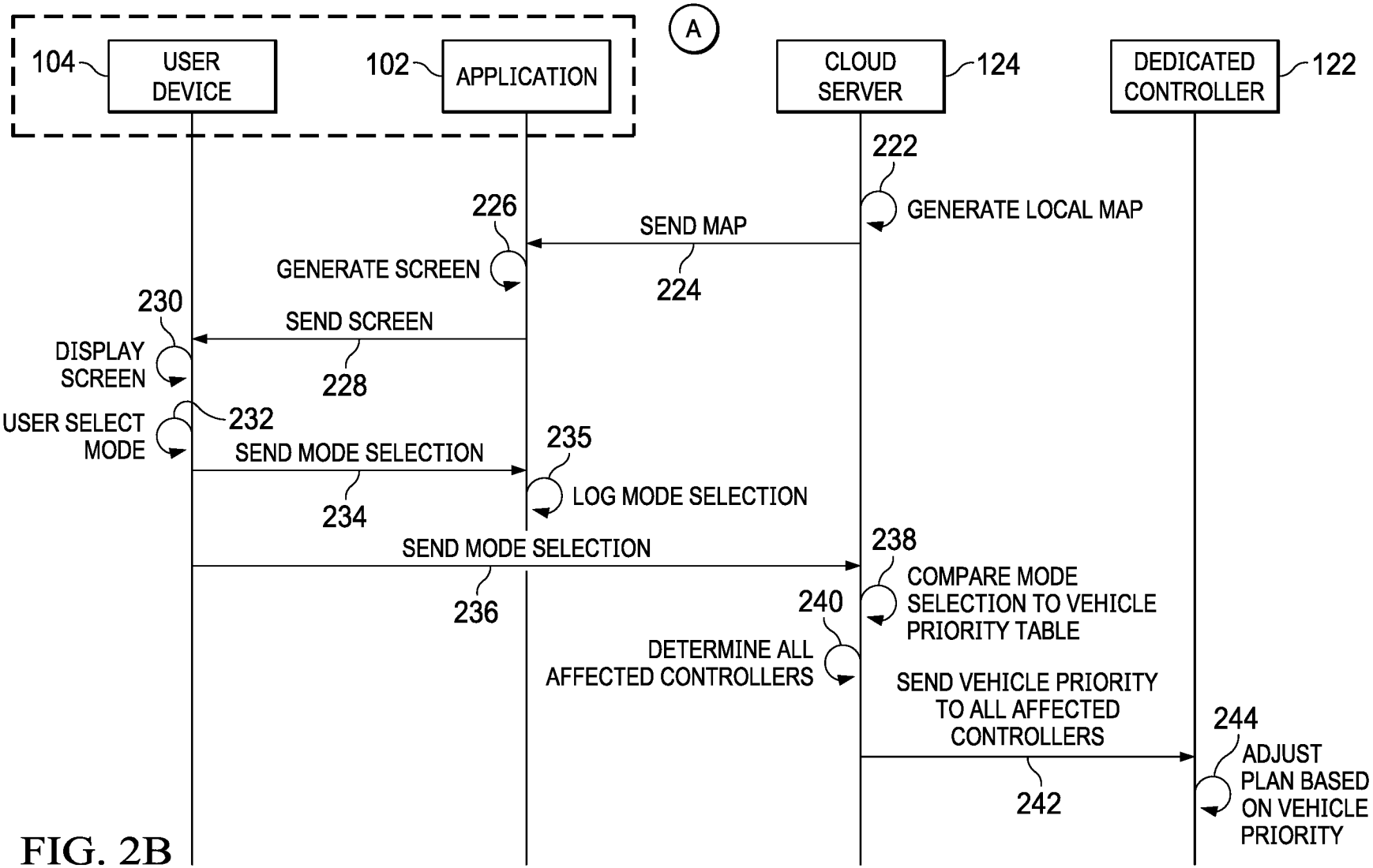

Referring then to FIGS. 2A and 2B, a sequence of steps required for mode selection in a preferred embodiment will be described. Mode selections may be used to adjust traffic light timing by the user devices, as will be further described.

At step 202, user device 104 opens application 102. At step 203, the user device sends an open request. At step 204, application 102 generates a time synchronization request. At step 205 the request is sent to cloud server 124. At step 206, cloud server 124 determines current time. At step 207, cloud server 124 sends the current time to application 102. At step 208, application 102 synchronizes an onboard clock of the user device to match the current time of the cloud server. At step 209, application 102 generates a GPS location request. At step 210, the GPS request is sent to the user device. At step 211, user device 104 determines its current GPS coordinates from an onboard GPS transceiver. At step 212, user device 104 sends the GPS coordinates to application 102. At step 213, application 102 logs the GPS coordinates. At step 214, a map request is generated. At step 216, the map request is sent to cloud server 124. At step 218, cloud server 124 logs the GPS coordinates of the user device. At step 220, the cloud server identifies all controllers located at intersections in a predetermined perimeter around the GPS coordinates. At step 222, cloud server 124 then generates a local map showing all roadways and intersections within the perimeter.

Figure 6:
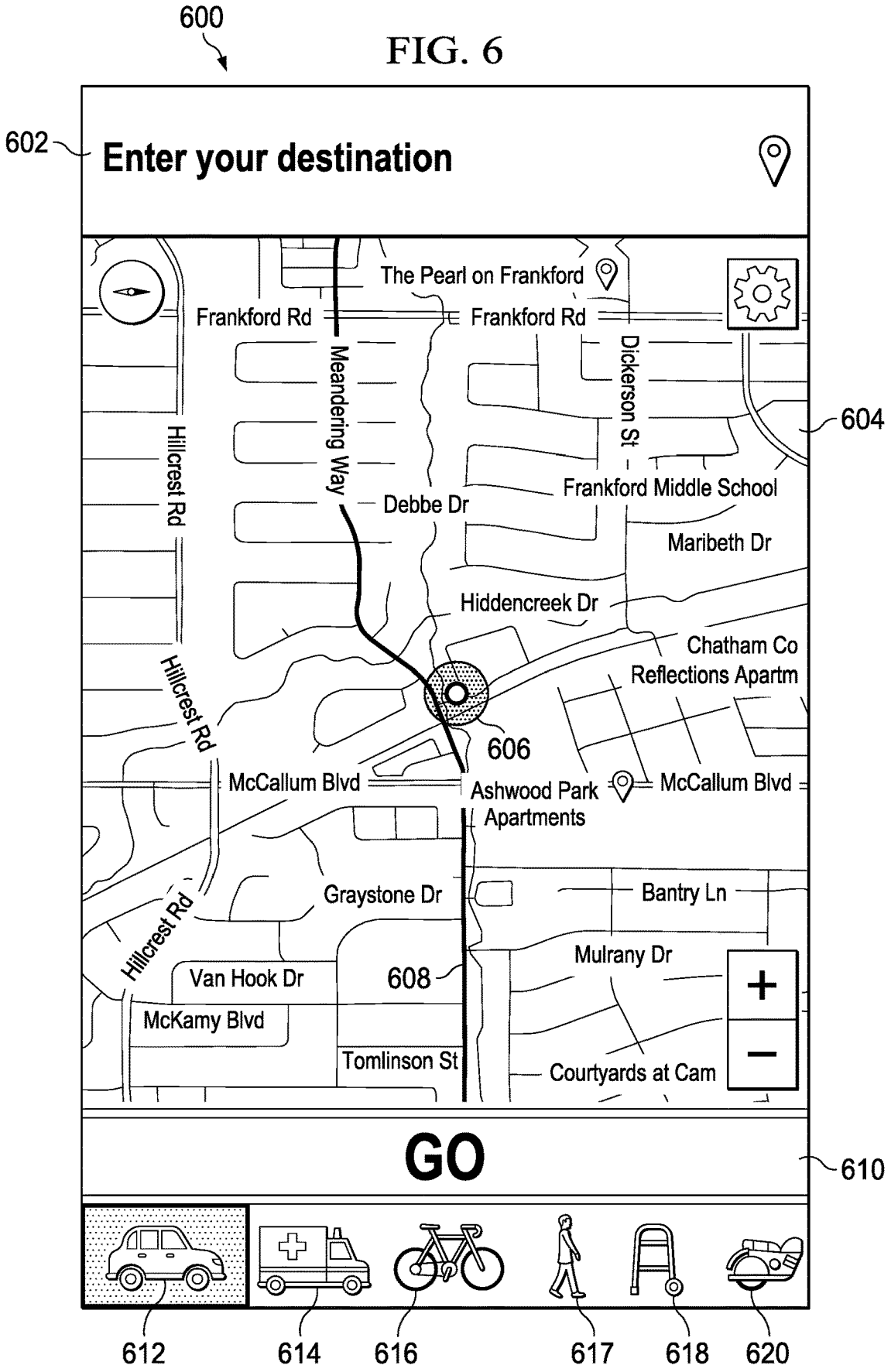
FIG. 6 is a GUI screen shot of a preferred embodiment

At step 224, cloud server 124 sends the map to the application. At step 226, application 102 generates a graphical depiction of the map and a graphical user interface (GUI) control screen. At step 228 the screen is sent to user device 104. At step 230, user device 104 displays the screen. An example of a preferable GUI screen is shown in FIG. 6.

At step 232, the user device receives a selection of transportation mode. In the preferred embodiment, the modes of transportation modes available for selection include automobile, emergency vehicle, bicycle, pedestrian, disabled and motorcycle. At step 234, the mode selection is transmitted to application 102. At step 235, the mode selection is logged by application 102.

At step 236, the mode selection is sent from the user device to cloud server 124. At step 238, cloud server 124 compares the mode selection to a priority table to determine the vehicle priority value. Each mode is assigned a different vehicle priority, $\omega_v$. The vehicle priority, $\omega_v$ is used by the controllers to calculate new phase plans to accommodate the passage of the vehicle with green lights, as will be further described. In a preferred embodiment, the following table indicates vehicle priority for each mode.

TABLE 1

| Mode | $\omega_v$ |
|---|---|
| Emergency Vehicle | 1 |
| Disabled | 0.8 |
| Motorcycle | 0.1 |
| Bicycle | 0.4 |
| Pedestrian | 0.5 |
| Automobile | 0.01 |

At step 240, cloud server 124 generates a list of all the controllers in the perimeter.

At step 242, the cloud server sends the vehicle priority to each affected controller in the list. At step 244, each affected dedicated controller 122 adjusts its traffic light timing plan based on the vehicle priority, as will be further described.

Figure 3A:
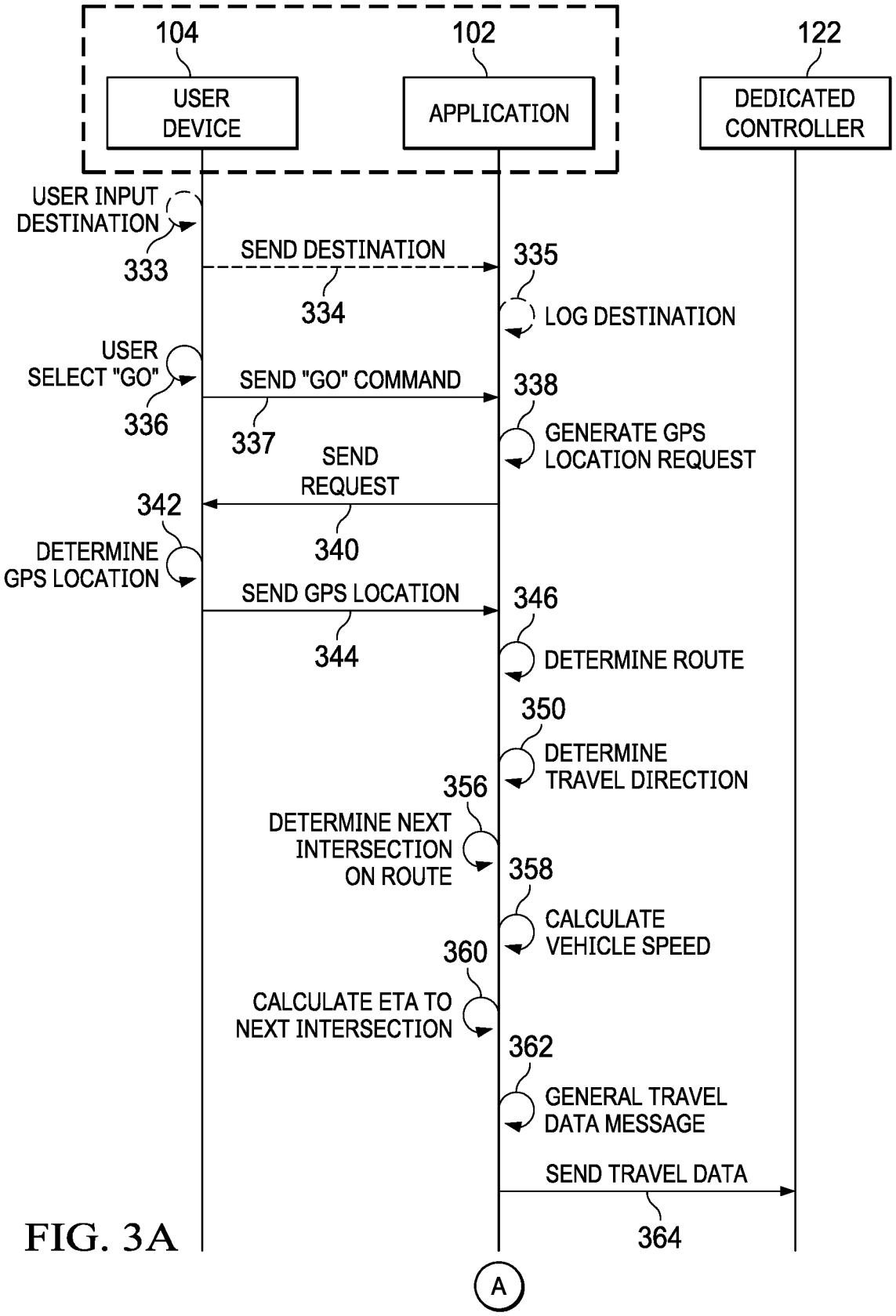
FIGS. 3A and 3B are a sequence diagram for a preferred embodiment of the method for collaborative distributed agent-based traffic light monitoring and alerting for vehicle mode.
Figure 3B:
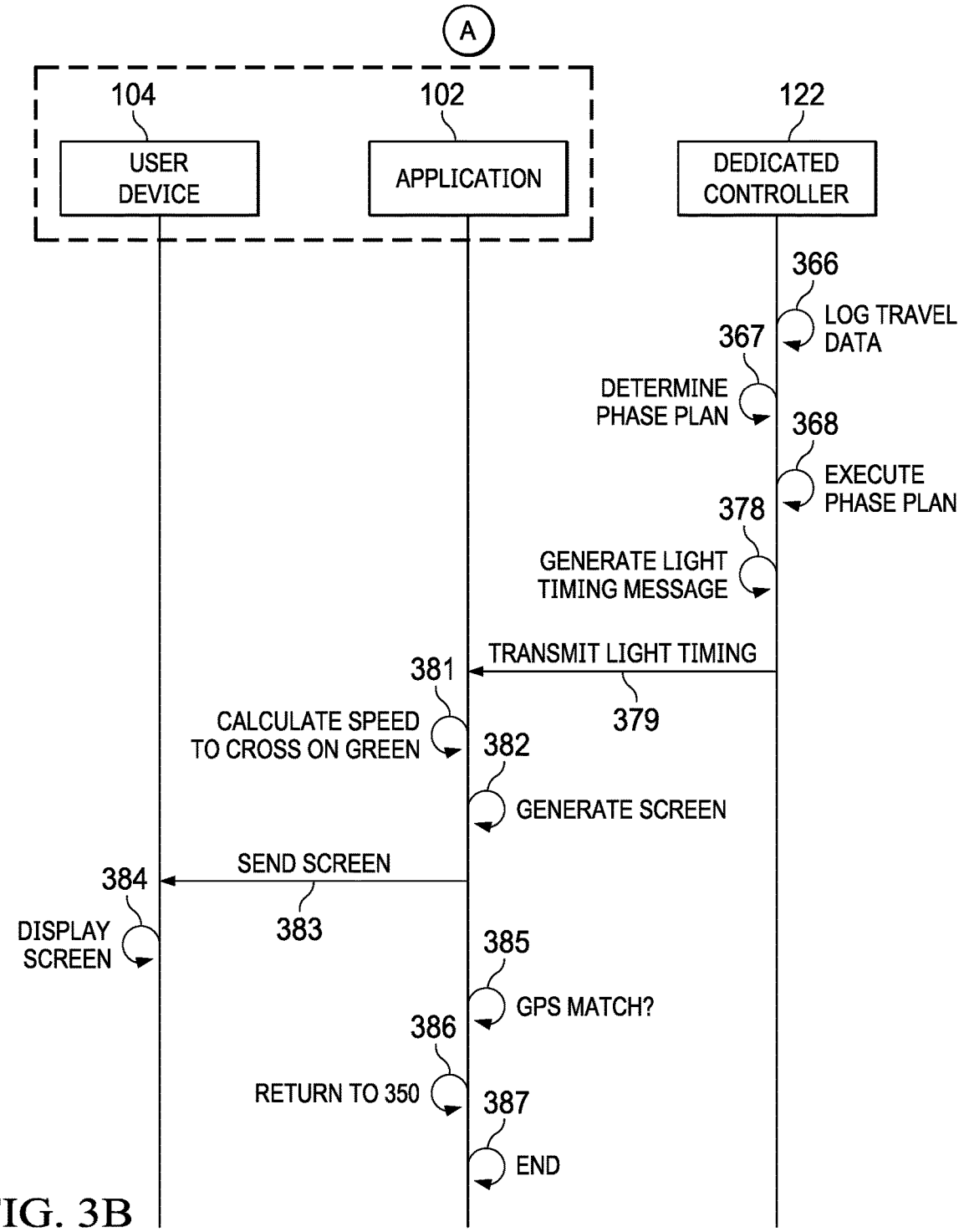

Referring then to FIGS. 3A and 3B, a preferred embodiment of "automobile mode", will be described. In this mode, a message is sent to the user device indicating the speed at which to travel to reach each upcoming intersection when the phase at that intersection is green.

In one preferred embodiment, the user device is presented with the option of choosing a destination. In this case, at step 333, the user device receives input of a destination address. At step 334, the destination is sent to application 102. At step 335, the destination is logged by application 102.

At step 336, the user device receives an activation signal from the GUI. At step 337, the activation signal is sent to application 102. At step 338, application 102 generates a GPS location request. At step 340, the GPS location request is sent to the user device. At step 342, user device 104 determines current GPS location of user device 104. At step 344, the GPS coordinates are sent to application 102.

At step 346, application 102 then compares the GPS location of the user device and the destination to the map to determines a route. At step 350, application 102 determines which direction the user device is traveling on the route. Optimized routing routines available from a Google Maps API are preferred for use in this step. If no destination is chosen, the route is assumed to end at the next intersection along the roadway in the direction of travel.

At step 356, application 102 determines the IP address of the controller located at the next intersection that user device will encounter on the route. In another embodiment, an ID is used for the controller instead of the IP address to protect the security of the controller. At step 358, application 102 calculates the speed at which the user device is traveling from a difference between GPS locations over time. In a preferred embodiment, this step is accomplished by continuously monitoring the GPS coordinates of the user device and subtracting them from the GPS coordinates of the next intersection on the route. At step 360, application 102 calculates the estimated time of arrival of the user device at the next intersection on the route according to the following equations:

$$t_2 = t_1 - \frac{\Delta d}{v} \quad \text{Eq. 1}$$

$$\Delta d = d_1 - d_2 \quad \text{Eq. 2}$$

The application solves for arrival time $t_2$, by subtracting the distance along the roadway between the current GPS location $d_1$, and the location $d_2$, of the next intersection, divided by the current velocity v, of the user device from the current time $t_1$. In an alternate embodiment this calculation may be performed by dedicated controller 122.

At step 362, application 102 generates a travel data message. The travel data message includes the vehicle priority, user device location, user device speed, route designation and the estimated time of arrival of the user device at the next intersection and sent to the controller at short, predetermined intervals. In a preferred embodiment, the travel data message is constantly updated by the application and is sent to the controller at short, predetermined intervals. The estimated time of arrival of the vehicle at the location of the intersection consistently becomes smaller as the vehicle approaches. Upon arrival, the estimated time of arrival approaches zero. In this way, the controller at the next intersection refines an accurate time of arrival to be used in adjusting the traffic light phase plan. At step 364, the travel data message is sent to dedicated controller 122.

At step 366, dedicated controller 122 logs the travel data. At step 367, dedicated controller 122 implements the vehicle priority and determines the appropriate traffic light phase plan to be used in adjusting traffic light cycles, as will be further described. At step 368, dedicated controller 122 executes the new phase plan to reduce delay. For instance, if dedicated controller 122 detects that there are no other vehicles at the intersection, then dedicated controller 122 may change the light cycle to green to facilitate the flow of traffic.

At step 378, dedicated controller 122 generates a message with light timing information. This message will contain the times of day that traffic lights 132 at the next intersection will be red/green/yellow for any given direction. At step 379, the light timing information is then transmitted to application 102.

At step 381, application 102 calculates the speed that user device should maintain to cross the intersection during a green light phase, according to the following equations:

$$v = \frac{\Delta d}{\Delta t} \quad \text{Eq. 3}$$

$$\Delta d = d_1 - d_2 \quad \text{Eq. 4}$$

$$\Delta t = t_1 - t_2 \quad \text{Eq. 5}$$

The application solves for velocity, v, by taking the distance along the roadway along the roadway between the user device GPS location $d_1$, and the GPS location of dedicated controller 122 $d_2$, and dividing by the difference between the time of day that the light cycle for that given direction will be green $t_1$, and the current time of day $t_2$.

At step 382, application 102 then generates a graphical depiction of a map and an appropriate GUI displaying the speed required to cross on green and the route of the user device. If it is impossible for the user device to reach the intersection on green at a reasonable speed, then application 102 will so indicate.

Figure 7:
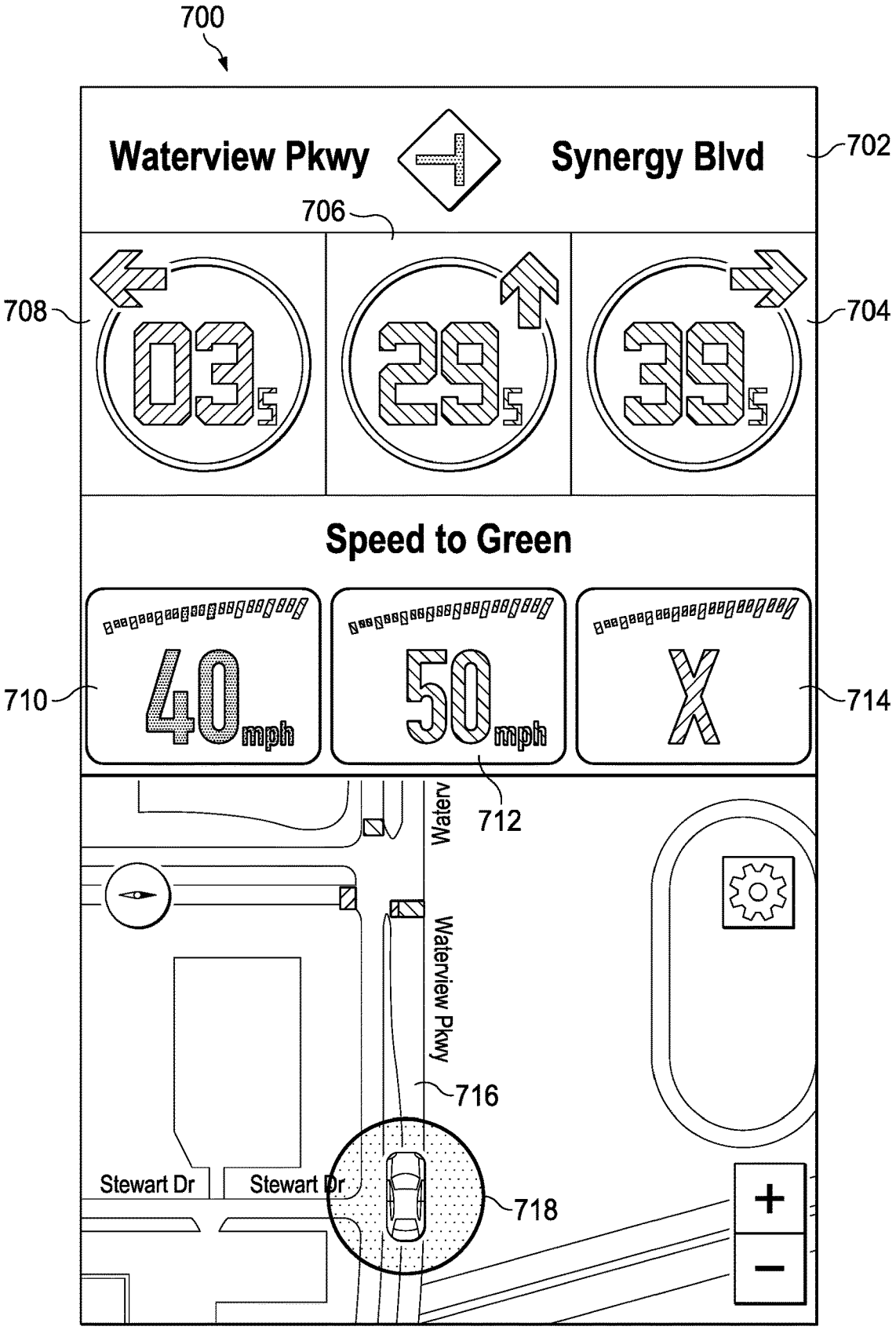
FIG. 7 is a GUI screen shot of a preferred embodiment.

An example of a preferable GUI when no destination is input is shown in FIG. 7.

Figure 8:
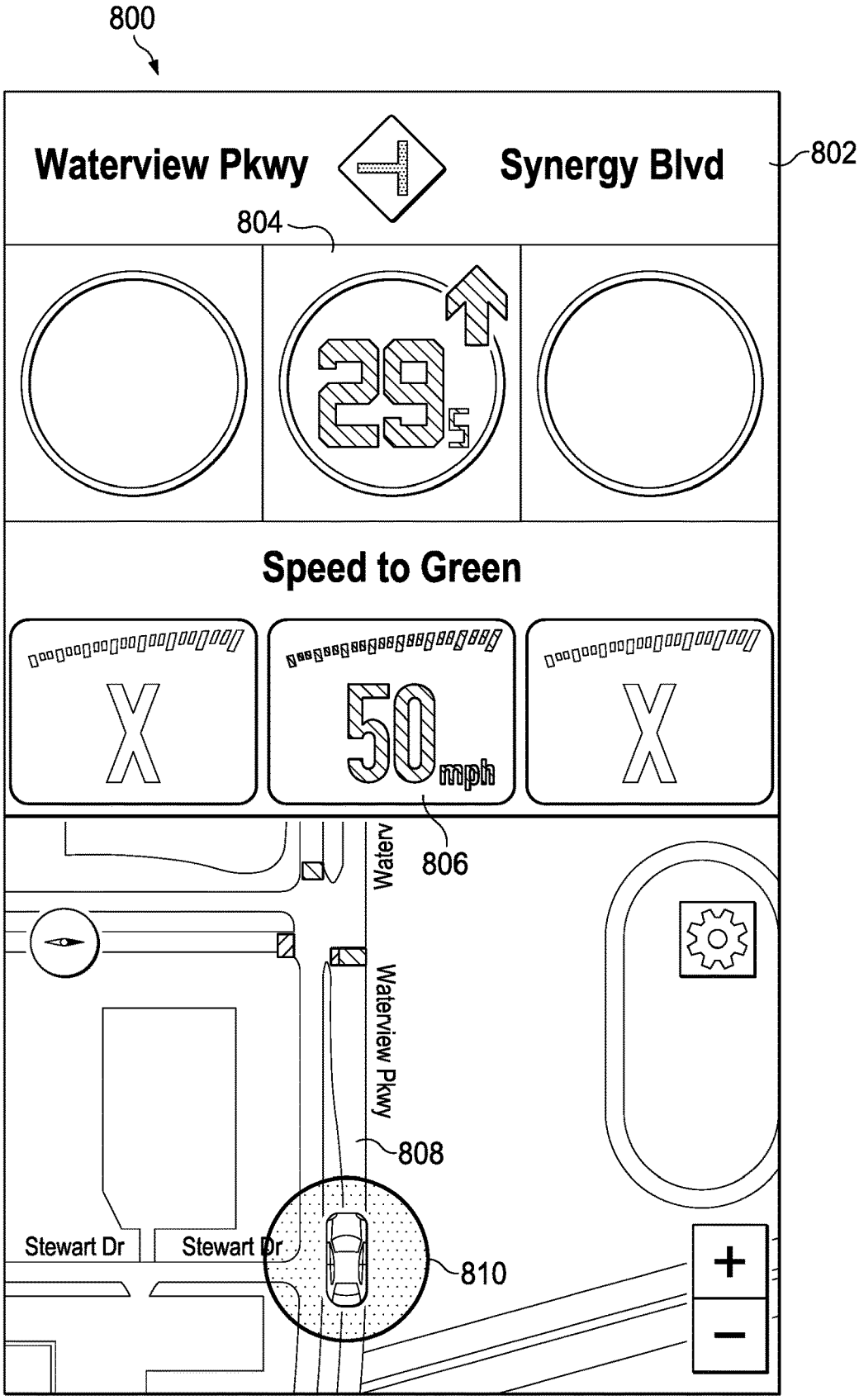
FIG. 8 is a GUI screen shot of a preferred embodiment.

An example of a preferable GUI when a destination is input is shown in FIG. 8.

At step 383, the appropriate screen is then sent to the user device. At step 384, the map is displayed. At step 385, the application consistently monitors the difference between the location of the user device and the location of the intersection. If the intersection is not the destination, then at step 386, the application returns to step 350. If the intersection is the destination, then at step 387, the application ends the routine.

Figure 4A:
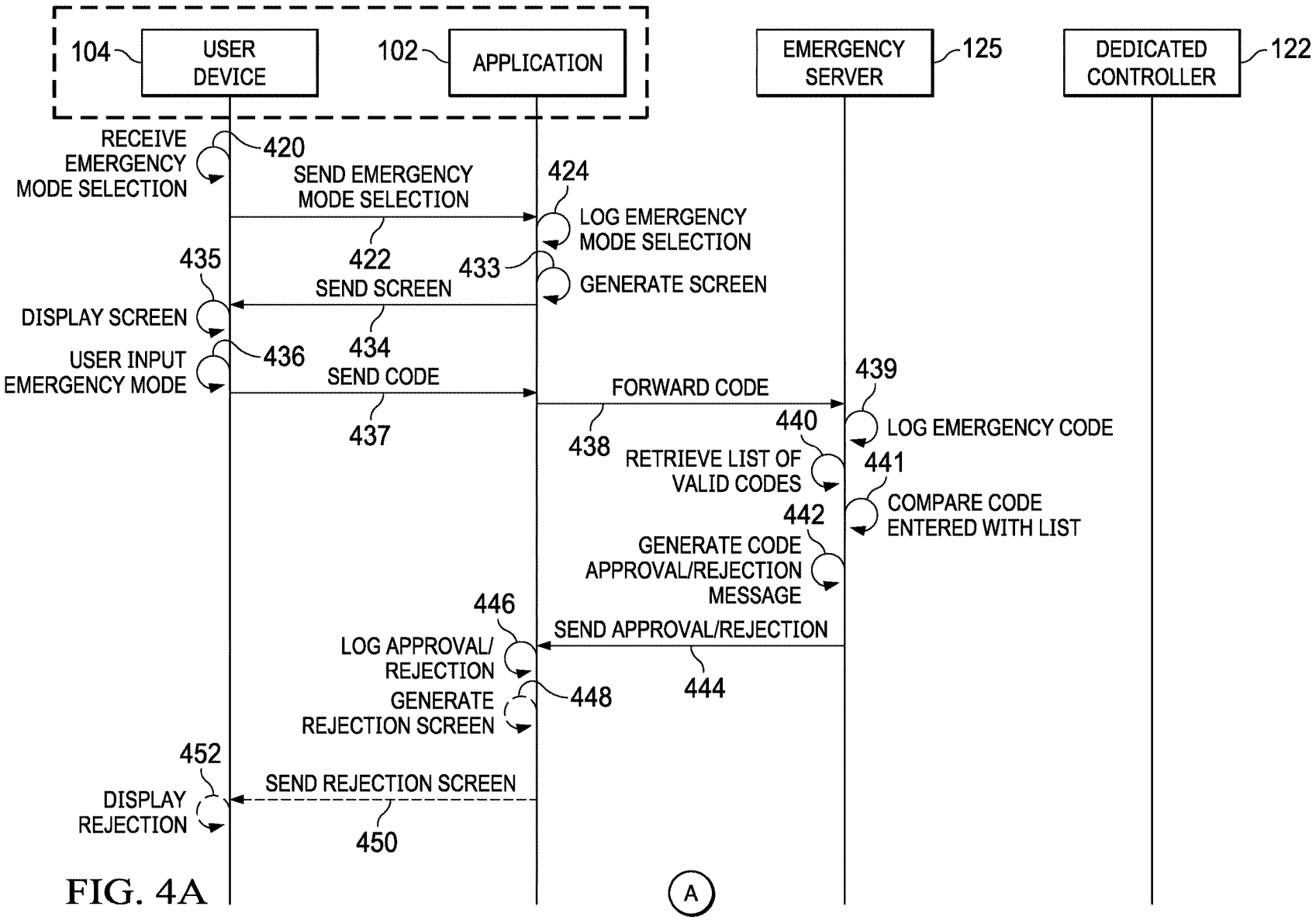
FIGS. 4A, 4B and 4C are a sequence diagram for a preferred embodiment of the method for collaborative distributed agent-based traffic light monitoring and alerting for emergency mode.
Figure 4B:
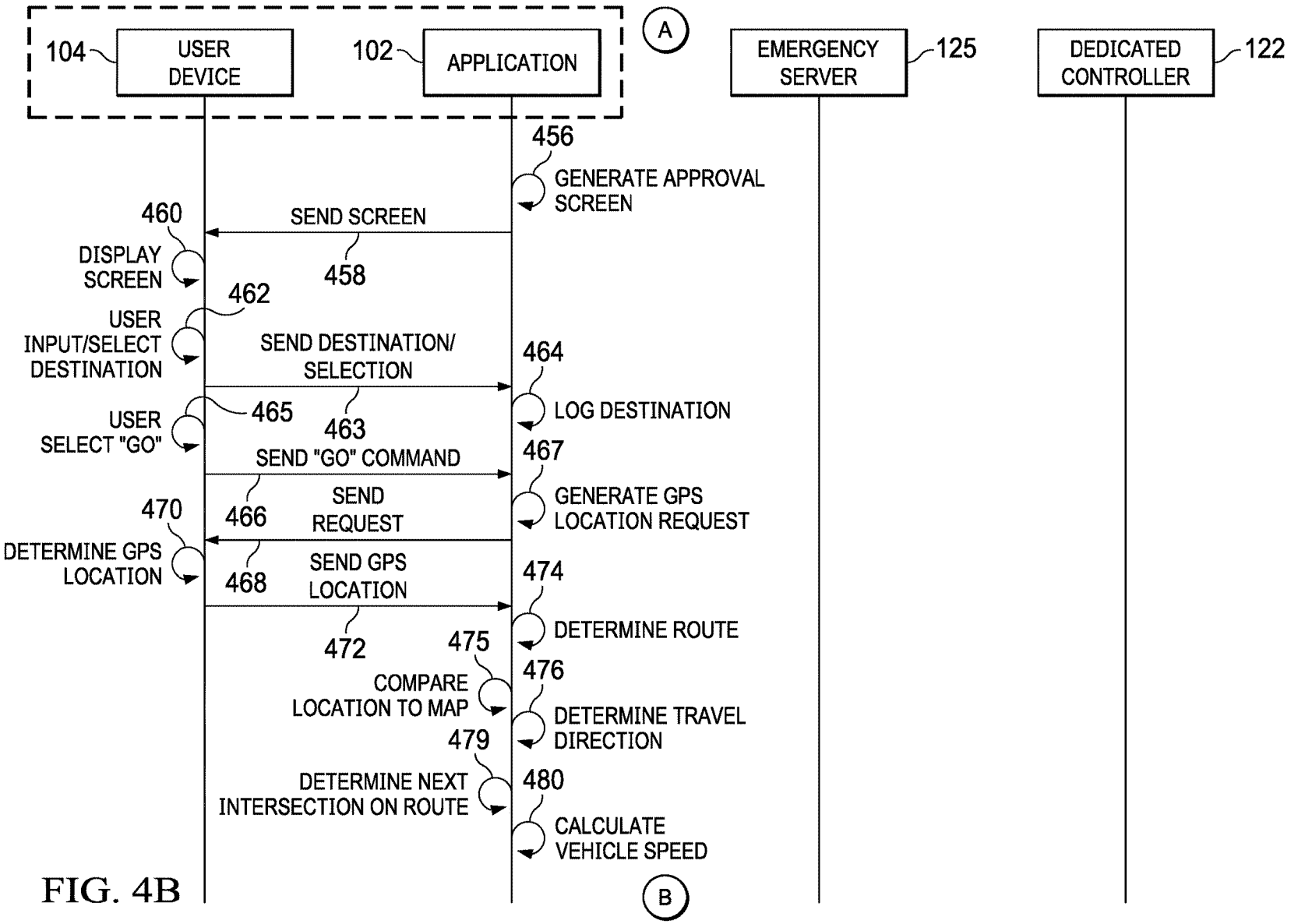
Figure 4C:
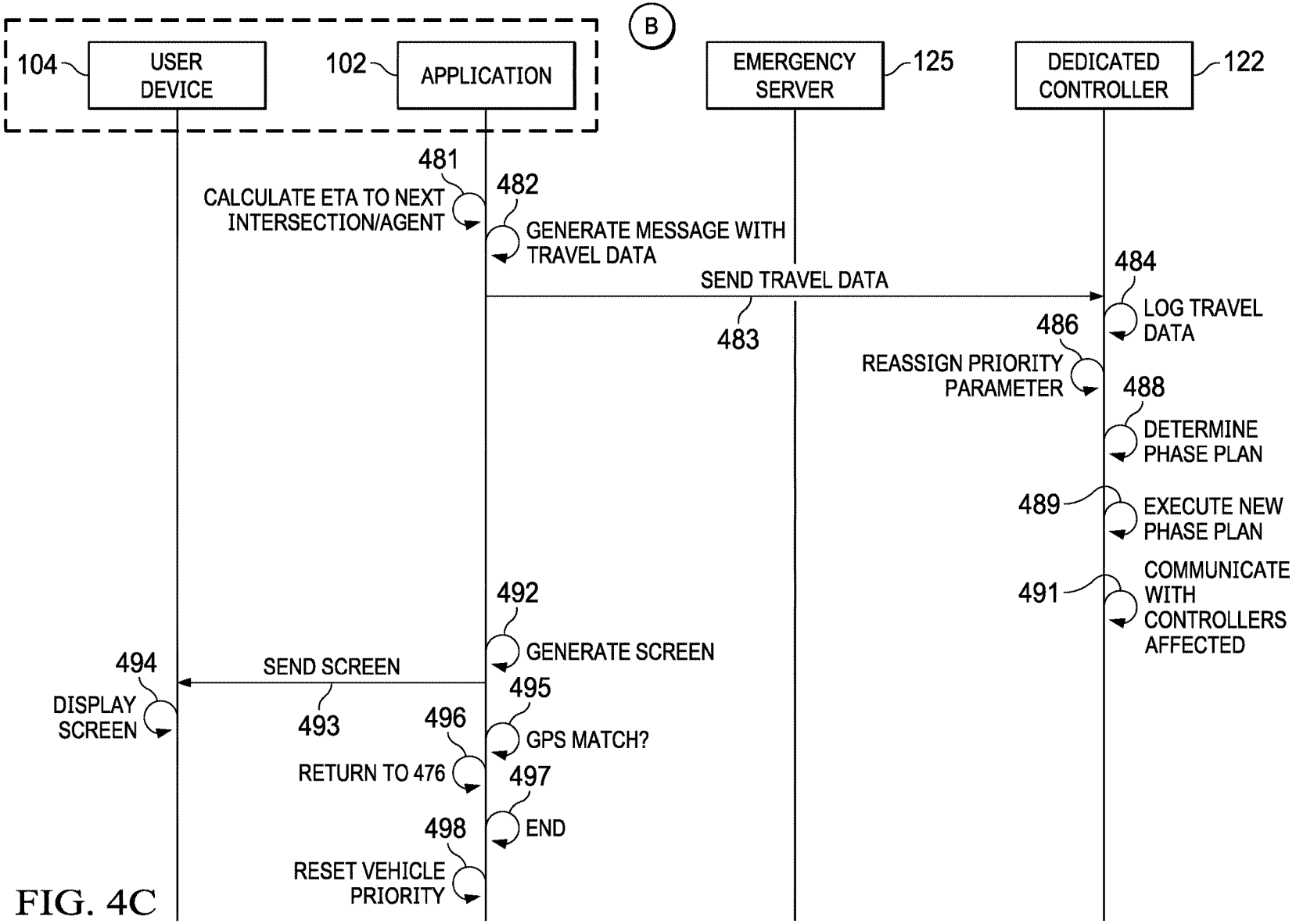

Referring then to FIGS. 4A, 4B and 4C, a sequence of steps required by the preferred embodiment in "emergency mode" will be described. In this mode, traffic lights along an emergency corridor are adjusted to be green at the time that the emergency vehicle arrives at each intersection.

A critically important effect of entering the emergency mode, as will become evident, is that the other controllers in the system outside the emergency corridor are still active and are still optimizing traffic flow through the collaborative system. The result is that even though the emergency corridor may create congestion, the other controllers sense the congestion as it arises and use the collaborative approach to dispel it. In this way, congestion is dissipated efficiently.

At step 420, user device 104 receives an emergency mode selection. An emergency mode selection sets the vehicle priority, $\omega_v$, to the maximum allowed. In a preferred embodiment, $\omega_v$, is set to 1. Of course, other values may be used. At step 422, the emergency mode selection is sent to application 102. At step 424, application 102 logs the emergency mode selection.

Figure 9:
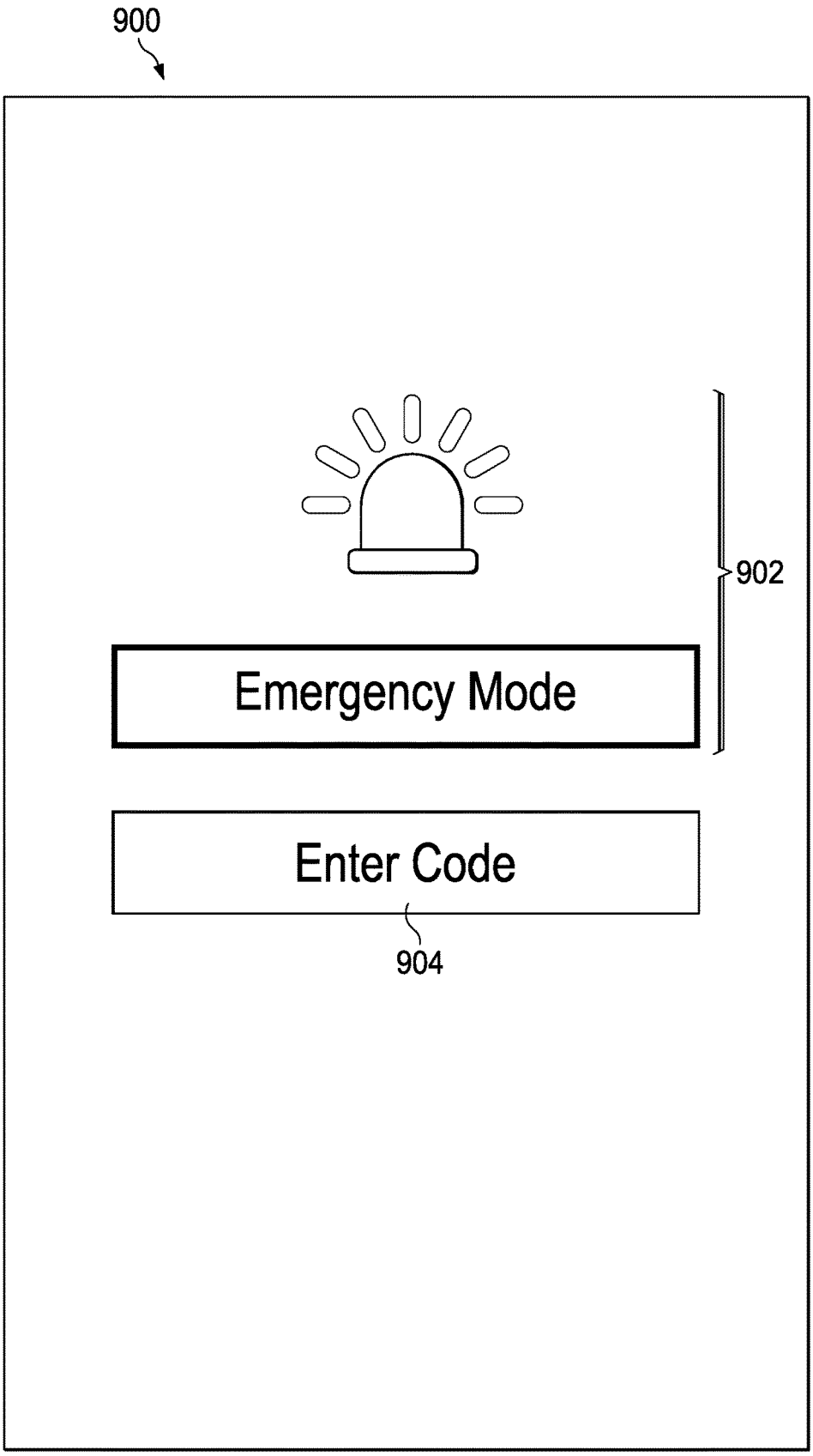
FIG. 9 is a GUI screen shot of a preferred embodiment.

At step 433, application 102 generates a graphical display with a GUI input for an emergency code. An example of a preferable GUI is shown in FIG. 9. At step 434, the screen is sent to user device 104, and at step 435 the screen is displayed on user device 104. At step 436, the user device receives input of an emergency code. At step 437, the emergency code is sent to application 102. At step 438, application 102 forwards the emergency code to emergency server 125.

At step 439, emergency server 125 logs the emergency code. At step 440, emergency server 125 retrieves a list of valid emergency codes. At step 441, emergency server 125 compares the input emergency code with the list of valid emergency codes. If the code is on the list it is approved, otherwise it is rejected. At step 442, a message indicating approval or rejection of the code is generated. At step 444, the code is sent to application 102. At step 446 application 102 then log the rejection or approval. At step 448, if rejected, then application 102 generates a rejection screen. At step 450, the rejection screen is sent to user device 104 and at step 452, the screen will be displayed on the user device.

Figure 10:
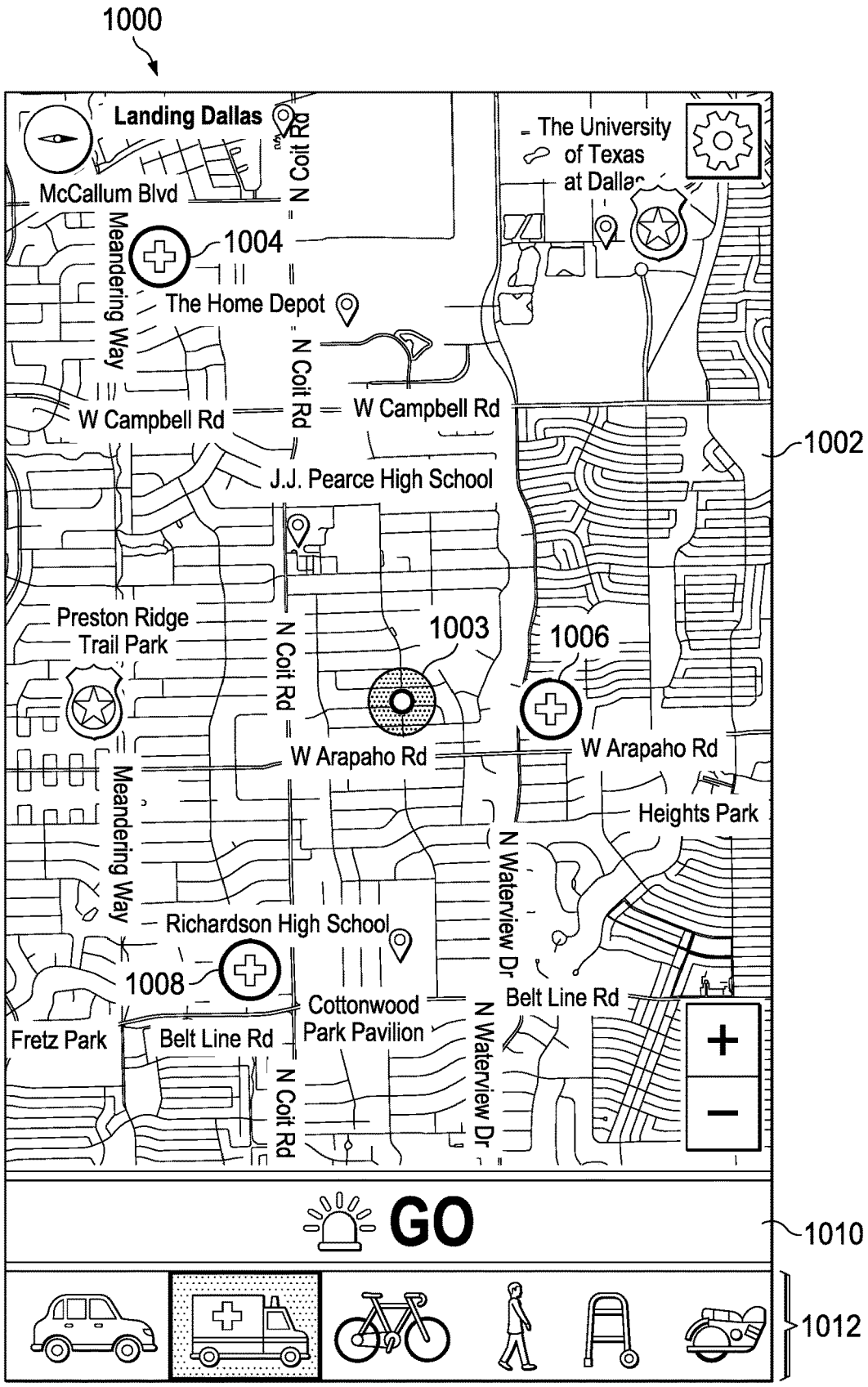
FIG. 10 is a GUI screen shot of a preferred embodiment.

At step 456, if the emergency code is approved, then application 102 generates a graphical depiction of a map and an appropriate GUI control screen. An example of a preferable GUI is shown in FIG. 10. At step 458, the screen is sent to user device 104 and displayed at step 460.

At step 462, user either inputs a specific destination, or selects a GUI icon for one of a set of pre-loaded emergency locations, such as hospitals, fire stations, and police departments. At step 463, the destination is sent to application 102. At step 464, application 102 logs the user destination. At step 465, the user device receives a selection of the "GO" GUI icon. At step 466, a "GO" command is sent to application 102.

At step 467, application 102 generates a GPS location request. At step 468, application 102 sends the request to the user device. At step 470, user device 104 determines its current GPS location. At step 472, user device 104 sends the current GPS location to application 102. At step 474, the application compares the current GPS location of the user device to the destination device to determine a route, as previously described. At step 475, application 102 then compares the route to the map to determine the intersections on the route. At step 476, application 102 determines which direction the user device is traveling. At step 479, application 102 determines the next intersection that the user device will encounter on the route and the IP address of the controller at that intersection. At step 480, application 102 calculates the speed at which the user device is traveling. At step 481, application 102 calculates the estimated time of arrival of the user device to the next intersection, as previously described.

At step 482, application 102 generates a travel data message. The travel data message includes the emergency mode status, a preassigned value of the vehicle priority, user device location, user device speed, route information and the estimated time of arrival of the user device at the next intersection. At step 483, the travel data message is sent to the dedicated controller at the next intersection; in this case, dedicated controller 122.

At step 484, dedicated controller 122 logs the travel data. At step 486, dedicated controller 122 reassigns its vehicle priority parameter, $\omega_v$, to match that included in the travel data. At step 488, dedicated controller 122 determines the appropriate phase plan based on the vehicle priority parameter, as will be further described. At step 489, dedicated controller 122 executes the new phase plan. When a controller receives the maximum vehicle priority, the phase plan is set to change the light phase cycle to green in the direction of traffic for about 10 seconds before arrival of the vehicle to about 10 seconds after departure of the vehicle. At step 491, dedicated controller 122 communicates new phase plan to all affected dedicated controllers.

At step 492, application 102 generates a graphical display of a map and GUI control screen which includes the user's route. An example of a preferable GUI is shown in FIG. 8. At step 493, the screen is sent to user device 104. At step 494, the screen displayed on the user device.

At step 495, the application monitors the GPS location of the user device for a match with the GPS location of the intersection. At step 496, if there is a match, the application returns to step 476. At setup 497, if the intersection is the destination, then the routine ends. At step 498, after departure of the vehicle, the vehicle priority parameters is reset to 0.

Figure 5A:
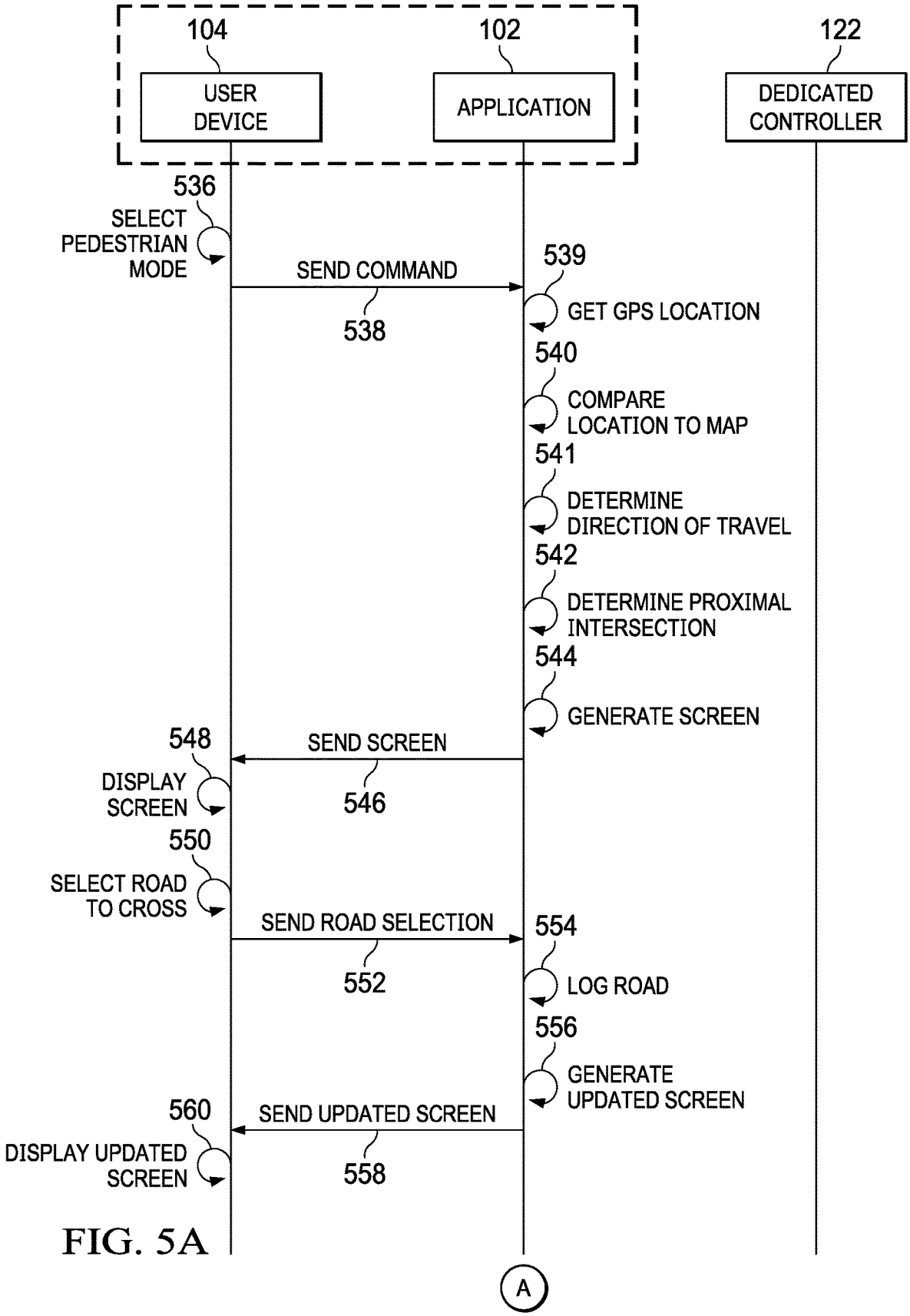
FIGS. 5A and 5B are a sequence diagram for a preferred embodiment of the method for collaborative distributed agent-based traffic light monitoring and alerting for pedestrian mode.
Figure 5B:
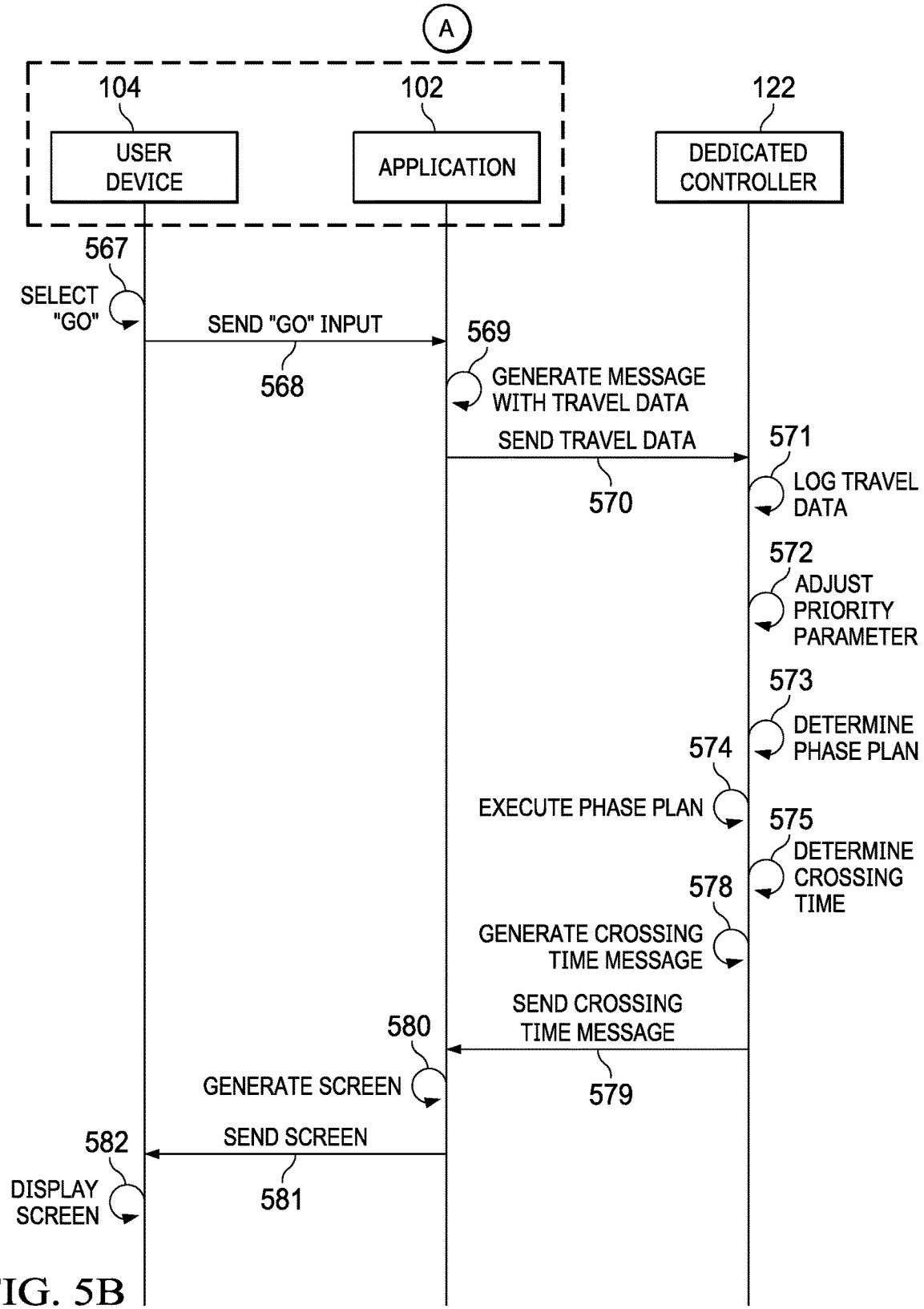

Referring then to FIGS. 5A and 5B, a preferred embodiment for "pedestrian mode" is described. In this mode, light timing is adjusted to stop vehicle traffic as a pedestrian is crossing an intersection.

At step 536, the user device receives selection of an activation signal from the GUI. In a preferred embodiment, the activation signal sends the mode selection to the application. At step 538, the command is sent to application 102.

Figure 11:
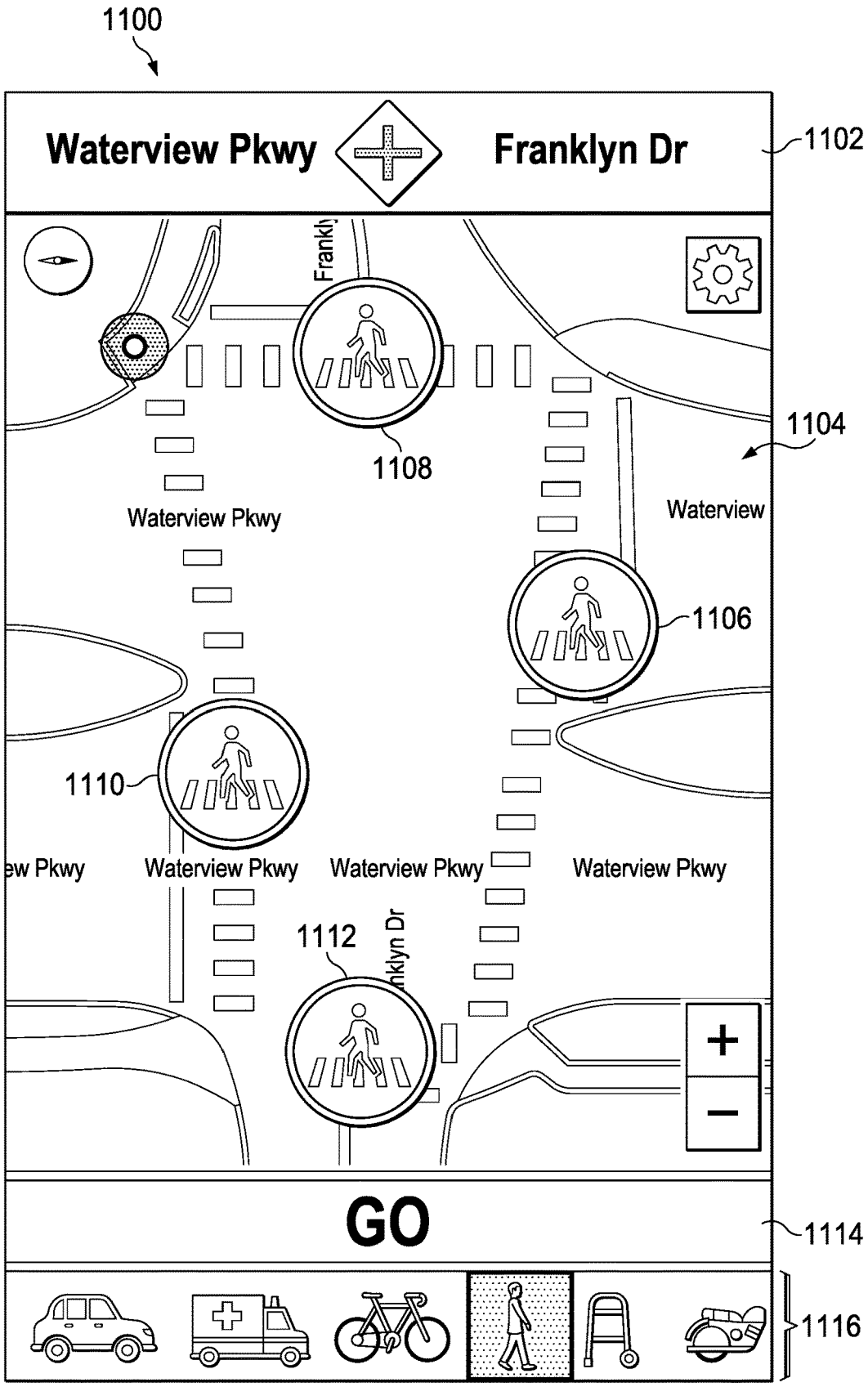
FIG. 11 is a GUI screen shot of a preferred embodiment.

At step 539, the application determines the GPS location of the user device. At step 540, application 102 compares the GPS location to a map stored in memory. At step 541, application 102 determines the direction of travel of the user device, as previously described. At step 542, application 102 determines the IP address of all dedicated controllers located at any intersections within a predetermined perimeter around the GPS location of the user device. At step 544, application 102 generates a graphical depiction of a map of the location of the nearest intersection along the direction of travel and the GPS location of each crosswalk at that intersection. A GUI screen is created that displays an aerial view of the intersection and a control icon at each crosswalk. An example of a preferable GUI is shown in FIG. 11. At step 546, the screen is sent to user device 104. At step 548, the screen is displayed on the user device.

At step 550, a crosswalk selection is received by the user device. At step 552, the selection is sent to application 102. At step 554, application 102 logs the crosswalk selection. At step 556, application 102 generates updates to the GUI control screen based on the crosswalk selection. The GUI control screen removes crosswalk control options which no longer apply based on the location and direction of travel of the user device.

At step 558, the GUI control screen updates are sent to user device 104. At step 560, the updates are displayed. At step 567, the user device receives a selection of the GUI object "GO". At step 568 the "GO" command is transmitted to application 102. At step 569, application 102 generates a travel data message. The travel data message includes the vehicle priority parameter, user device location, user device route information, and including the selected crosswalk to cross. At step 570, the travel data message is sent to the dedicated controller located at the intersection, such as dedicated controller 122.

At step 571, dedicated controller 122 logs the travel data message. At step 573, dedicated controller 122 adjusts its vehicle priority parameter to match that in the pedestrian vehicle priority value in the travel data. At step 572, dedicated controller 122 determines the appropriate traffic light phase plan to accommodate the vehicle priority and the selected crosswalk.

In a preferred embodiment, a pedestrian vehicle priority sets the phase plan to red at only the directions of traffic flow that interfere with the crosswalk selected. In another embodiment, the phase plan sets all traffic lights to red for an extended cycle, such as when "handicap mode" is selected. At step 574, dedicated controller 122 executes the new phase plan. At step 575, dedicated controller 122 determines the time that it will take the user device to cross the intersection at its current position and speed. At step 578, application 102 generates a message including the time required to cross the intersection. At step 579, the time is then transmitted to application 102.

Figure 12:
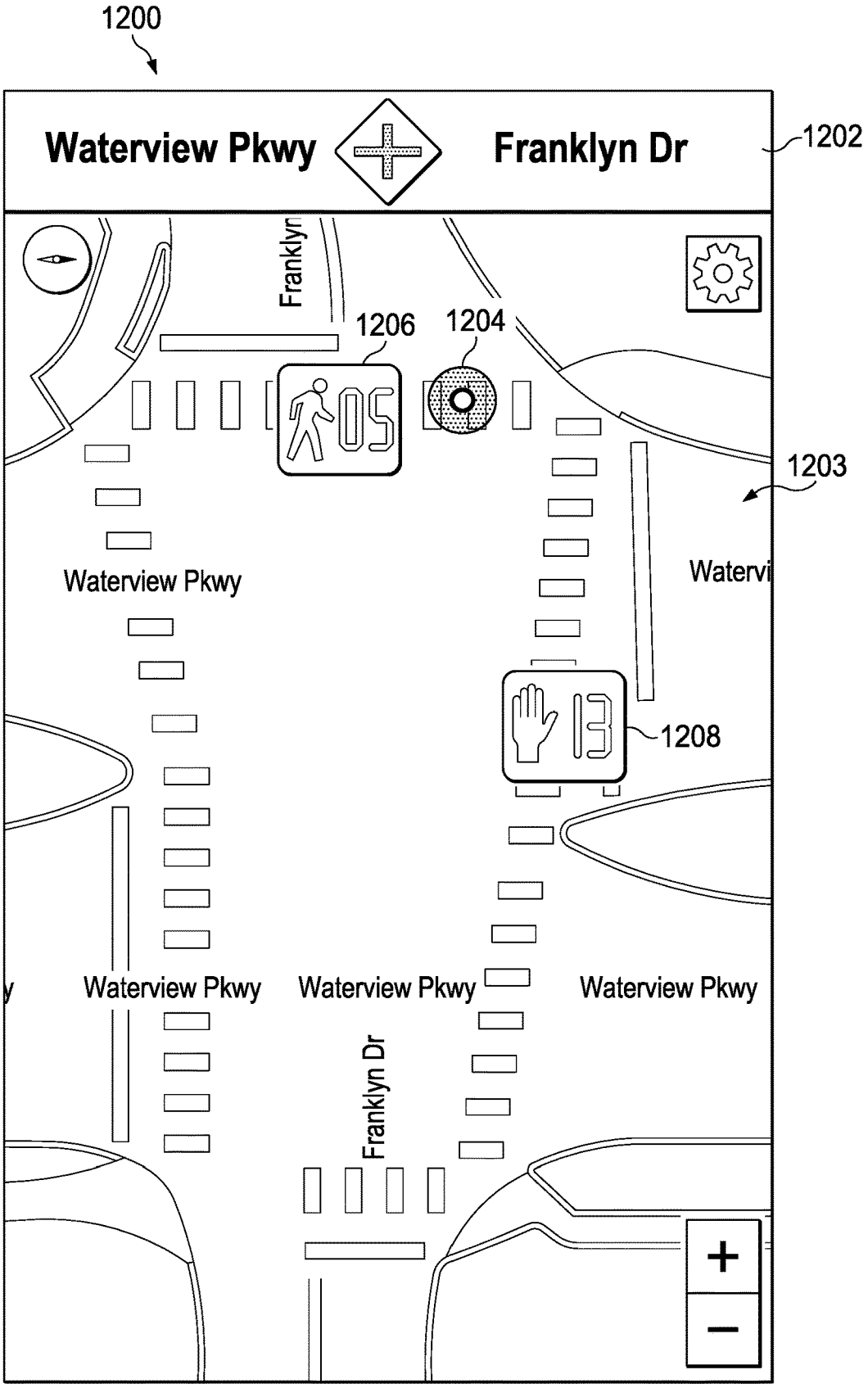
FIG. 12 is a GUI screen shot of a preferred embodiment.

At step 580, application 102 generates a graphical depiction of a map of the intersection with pedestrian crossing time. An example of a preferred embodiment of the display screen is shown in FIG. 12. At step 581, the screen is then sent to user device 104. At step 582, the screen is displayed on the user device. The time to cross is updated constantly on the display by reference to the internal clock of the user device.

Referring then to FIG. 6, mode selection screen 600 will be described.

Mode selection screen 600, includes destination text entry form 602, map 604, destination icon 606, route display 608, control button 610, and mode selection buttons 612, 614, 616, 618 and 620.

Destination text entry form 602, preferably, allows data entry from a keypad of a mobile device. In another preferred embodiments, the destination text entry form may include a dropdown box with preselected locations, known to exist on a map.

Map 604 shows a display of a two-mile radius of a local map centered at the location of the user device, generated as previously described.

Destination icon 606 shows the designation of the destination entered, on the map, from the destination selection.

Route 608 shows a calculated path, along a known road, on the map, between the GPS location of the user device and the GPS location of the destination.

Control button 610 is provided to initiate certain functions of the application, as previously described.

Mode selection button 612 indicates a vehicle. Attributes related to vehicle, such as average speed, vehicle priority and recommended travel paths are retrieved and stored in each dedicated controller, as will be further described. Likewise, mode selection button 614 indicates an emergency vehicle, and activates attributes of an emergency vehicle, such a preselected code entry screens, as will be further described. Likewise, mode selection button 616 indicates a bicycle mode, with appropriate attributes, as will be further described. Mode selection button 617 indicates a pedestrian, including appropriate parameters for pedestrian transportation. Mode selection button 618 indicates a handicap mode of transportation, including appropriate attributes, as will be further described. Likewise, mode selection button 620 indicates a motorcycle mode of transportation, with appropriate attributes, as will be further described.

Referring to FIG. 7, preferable GUI display 700 when no destination is input, will be described.

Route display 702 displays the roadway names of the next intersection and the intersection type. At display location 708, the time to the next intersection along any left-hand turn route is displayed. At display location 706, the time to the next straight-ahead traffic intersection is displayed. Likewise, at display location 704, the time to any right-hand turn intersection is displayed.

At display location 710, the speed required to reach the first intersection along the left-hand turn route while the intersection is in the green phase is displayed. Likewise, at display location 712, the speed to reach the straight-ahead intersection on the green phase is displayed. Likewise, display location 714, the speed to reach the next intersection along the first right hand turn route while on the green phase is displayed. In this example, no reasonable speed will reach the next right-hand turn intersection in time for the green phase, therefore, an "X" is displayed instead of a recommended speed.

In a preferred embodiment, the GUI display the aerial view of route at 716. In a preferred embodiment, icon 718 displays the GPS location of the user device.

Referring to the FIG. 8, preferable GUI display 800 is shown when a destination is input.

In this example text display 802 shows the next intersection along the preferred route to the destination.

Display area 804 shows the time to the next intersection period.

Display area 806 the recommended speed to reach the next intersection while on the green phase is displayed.

In a preferred embodiment, aerial view of the route is displayed at 808. At 810, an icon is displayed indicating the GPS location of the user device.

Referring to FIG. 9, a preferable GUI data entry screen 900 for emergency mode will be described.

Screen 900 include emergency mode indicator 902 and data entry field 904.

Data entry field 904 allows the user device to receive a code to activate the emergency mode, as previously described.

Referring then to FIG. 10, an example of a preferable GUI for emergency mode display 1000, will be described.

Display 1000 includes map 1002. An icon showing GPS location of the user devices shown at 1003. Icons for prioritized locations, 1004, 1006 and 1008 are displayed within a predetermined perimeter around the GPS location of the user device.

Activation button 1010 is provided. Further, mode override buttons 1012 are also provided, which allows the user to override preselected mode type.

Referring then to FIG. 11, a preferable example for a pedestrian crossing priority 1100 will be described.

Display location 1102 displays an identification of the intersection at which the user device is located. Similarly, an aerial display of the intersection is shown at 1104. Control icons 1106, 1108, 1110 and 1112 indicate alternate crosswalk selections.

Activation button 1114 is provided to allow the user device to alert the application to a pedestrian crossing an intersection.

Mode override buttons 1116 are provided to change the pre-determined mode of the application.

Referring then to FIG. 12, a preferred GUI display for a graphical description of pedestrian crossing time 1200, will be described Display 1200 includes display area 1202 indicating the location of the intersection. Icon 1204 is provided indicating the GPS location of the user device. At each roadway crossing an icon is provided. Icon 1206 indicate the amount of crossing time available to a pedestrian. Icon 1208 indicates the amount of wait time before a pedestrian may cross an adjoining roadway.

Display area 1203 shows an aerial view of the intersection closest to the GPS location of the user device.

Figure 13A:
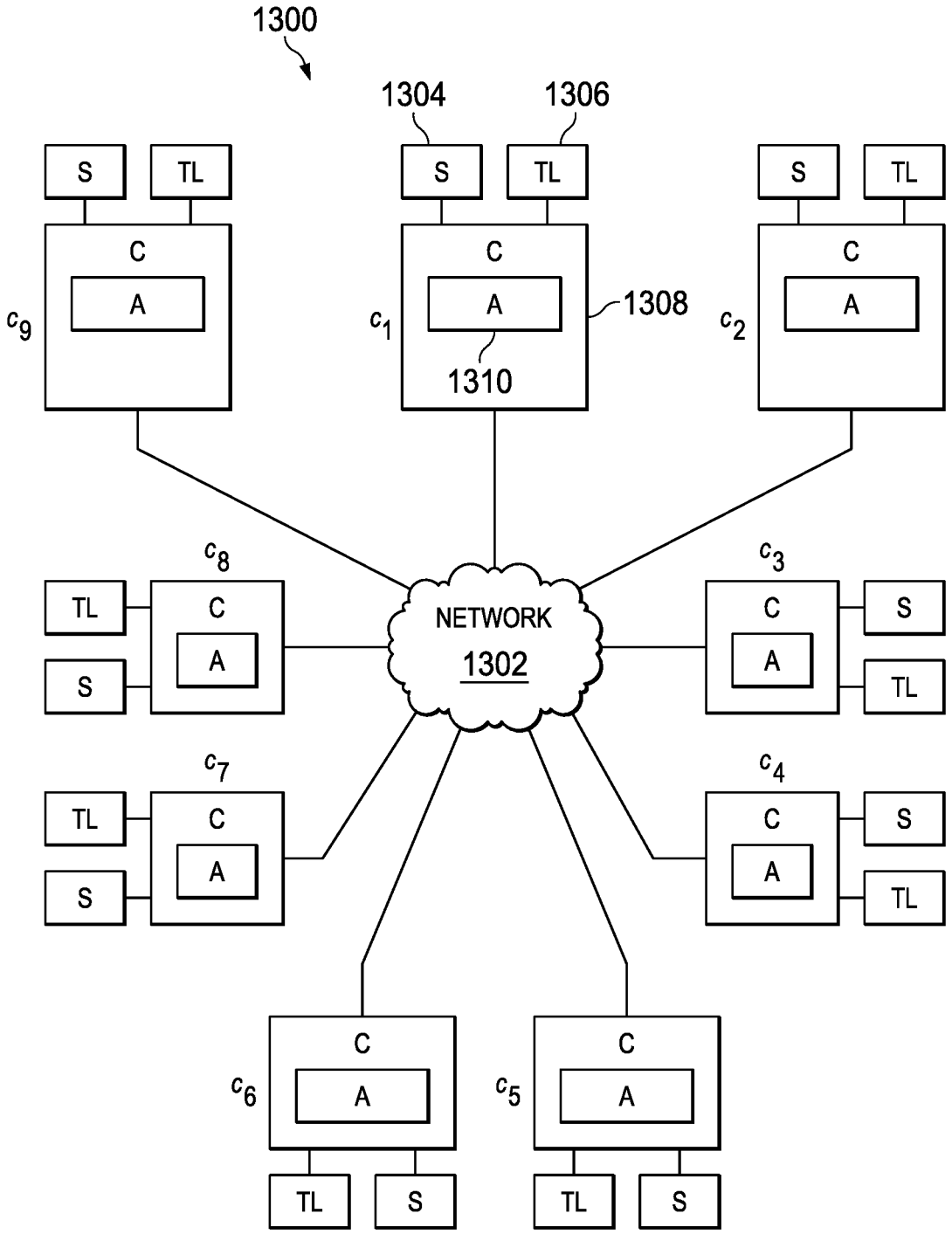
FIG. 13A is an architecture diagram of an example of a preferred system of collaborative distributed agent-based controllers.

Referring to FIG. 13A, an alternate network 1300 of dedicated microcontrollers will be described. This embodiment may be used in conjunction with the embodiment shown in FIG. 1.

Network 1300 includes dedicated controllers $c_1$, $c_2$, $c_3$, $c_4$, $c_5$, $c_6$, $c_7$, $c_8$, and $c_9$ all connected through wide area network 1302. A greater or lesser number of controllers may be employed. In a preferred embodiment, wide area network 1302 is the Internet. Interconnections between the controllers and the wide area network are carried out by fiber or wireline connections and attached network adapters (not shown) resident in each controller. Each of controllers $c_1$ through $c_9$ includes a microcontroller, such as microcontroller 1308 including an embedded application, such as application 1310 stored in local memory, as will be further described. Each of the controllers is operatively connected to a set of sensors, such as sensors 1304 and a set of traffic lights, such as traffic lights 1306.

Figure 13B:
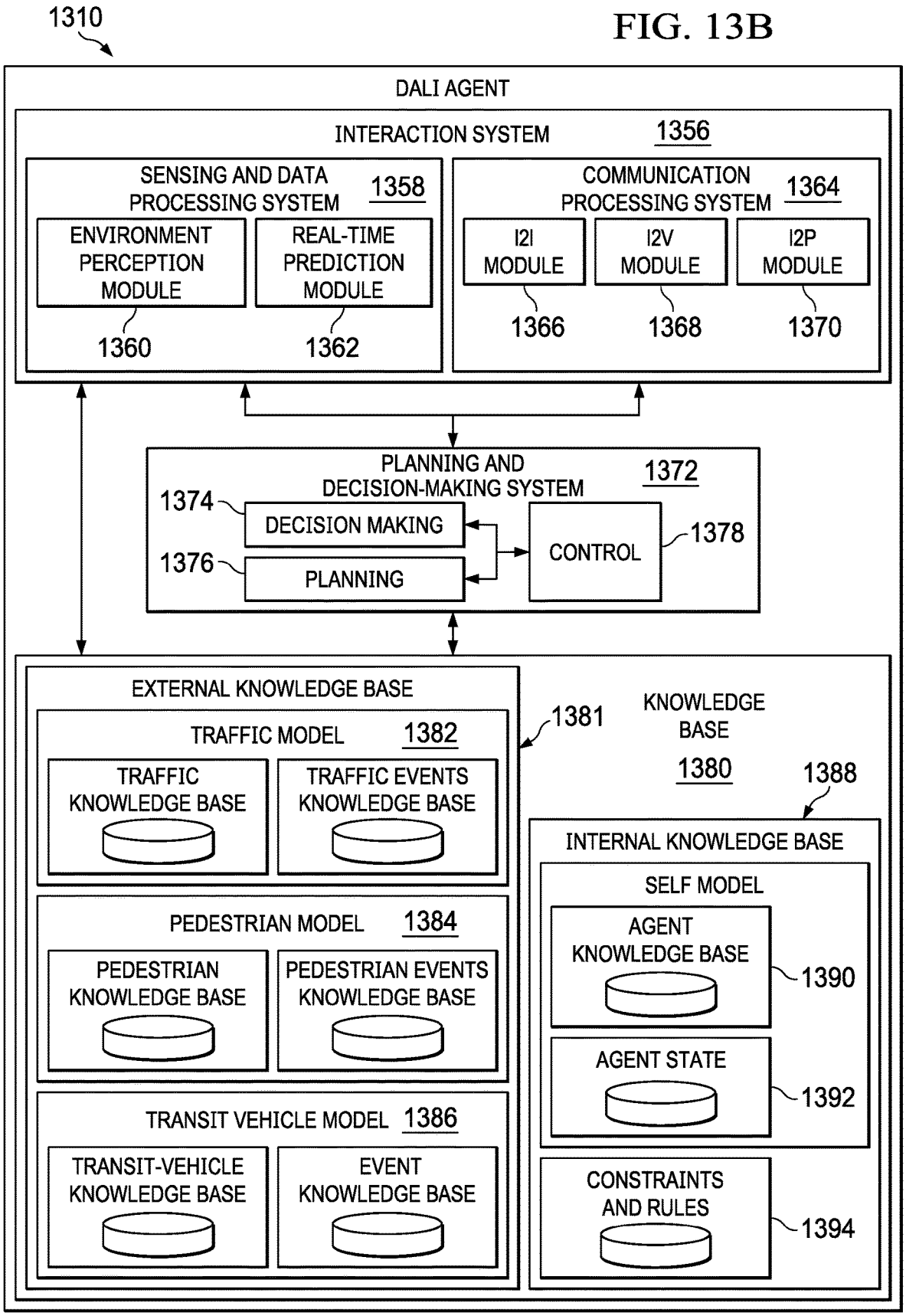
FIG. 13B is an architecture diagram for a preferred embodiment of a dedicated controller.

Referring then to FIG. 13B, application 1310 will be further described.

Application 1310 comprises an interaction system 1356.

Interaction system 1356 further comprises sensing and data processing system 1358 and communication processing system 1364.

Sensing and data processing system 1358 further comprises environment perception module 1360 and real-time prediction module 1362. In a preferred embodiment, environment perception module includes appropriate connections to sensors 1304. Sensors 1304 can include radar sensing systems, magnetic or induction coil systems or video systems adapted to sense the presence of traffic at the intersection at which the application is installed. Other traffic and pedestrian sensing systems may be employed. Real-time prediction module 1362 includes algorithms for traffic planning, as will be further described.

Communication processing system 1364 includes module 1366, module 1368 and module 1370. In a preferred embodiment, module 1366 includes the network interface to the wide area network and facilitates communications with other controllers, servers and user devices. In a preferred embodiment, module 1368 includes the appropriate circuitry to drive the 110V relays that operate the traffic lights. In a preferred embodiment, module 1370 includes the interface to removable memory storage, such as a flash drive.

Interaction system 1356 communicates with planning and decision making system 1372. Planning and decision making system further comprises decision making module 1374, planning module 1376 and control module 1378.

In a preferred embodiment, decision making module 1374 includes algorithms for traffic control, as will be further described.

In a preferred embodiment, planning module 1376 includes algorithm for traffic control, as will be further described.

In a preferred embodiment, control module 1378 implements communication through the communication processing system to other applications installed on controllers at neighboring intersections, servers and user devices.

Knowledge base 1380 further comprises external knowledge base 1381 and internal knowledge base 1388.

External knowledge base 1380 further comprises traffic model 1382, pedestrian module 1384 and transit vehicle module 1386.

Traffic module 1382 includes a traffic knowledge base and a traffic events knowledge base. In a preferred embodiment, these knowledge bases include a historical records of traffic flow patterns and accident incidents which occur at the intersection.

Pedestrian module 1384 includes a pedestrian knowledge base and a pedestrian events knowledge base. In a preferred embodiment, these knowledge bases include a historical record of pedestrian flow patterns and incidents which occur at the intersection.

Transit vehicle module 1386 includes a transit vehicle knowledge base and a transit vehicle events knowledge base. In a preferred embodiment, these knowledge bases include a historical record of transit vehicle flow patterns and accident incidents which occur at the intersection.

Internal knowledge base 1388 further comprises agent knowledge base 1390, agent state 1392 and constraints and rules module 1394. In a preferred embodiment, agent knowledge base 1390 includes functions and definitions necessary for application 1310 to function, as will be further described. Agent state 1392 further comprises a self-monitoring function which reports whether or not application 1310 is in a functional state.

Constraints and rules modules 1394 includes relationship tables for neighboring controllers and definitions for the intersection at which the controller is positioned.

Figure 14:
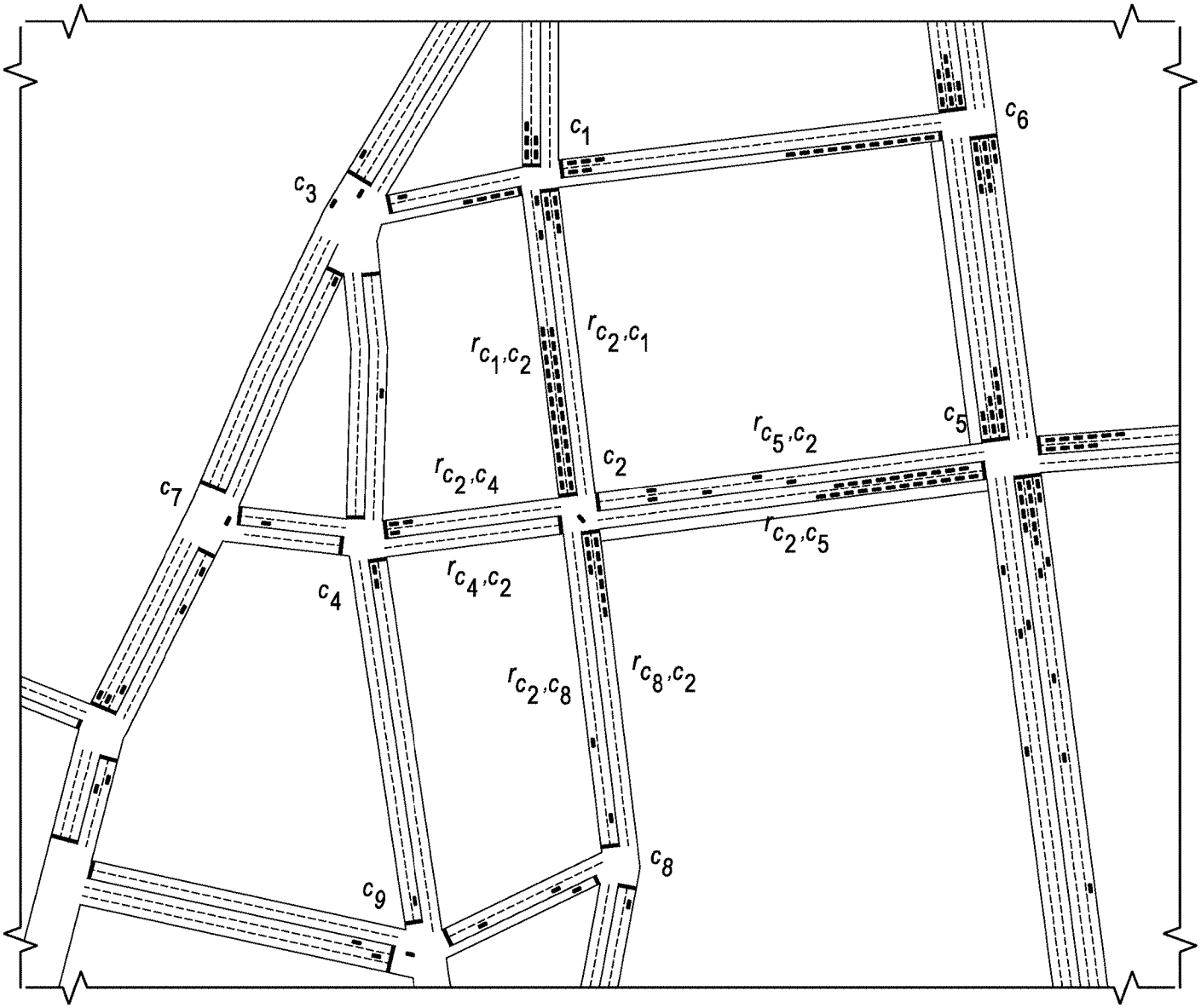
FIG. 14 is a traffic intersection network example.

Referring to FIG. 14, an example of the logical connections between the controllers will be described.

In one preferred embodiment, each controller is connected only to its immediate neighbors. In this example, controller $c_1$ is connected to controllers $c_3$ and $c_2$. Connector $c_2$ is connected controller $c_1$, $c_4$, $c_5$ and $c_8$. Controller $c_3$ is connected to controller $c_1$, $c_2$, $c_4$ and $c_7$. Controllers $c_4$ is connected to controller $c_3$, $c_7$ and $c_9$. Controller $c_9$ is connected to controller $c_4$ and $c_8$. In other embodiments, the controllers may also be connected to other controllers, servers, and user devices through network interface cards, as previously described.

Each controller maintains a table in memory of the IP addresses of each of the controllers to which it is connected. This table, stored in local memory of each controller, is used to facilitate communications between the controllers. An example of a controller map memory table is shown below.

TABLE 2

| Controller | Next Neighbors | | | |
|---|---|---|---|---|
| $C_1$ | $C_2$ | $C_3$ | | |
| $C_2$ | $C_1$ | $C_4$ | $C_5$ | $C_8$ |
| $C_3$ | $C_1$ | $C_4$ | $C_7$ | |
| $C_4$ | $C_2$ | $C_3$ | $C_7$ | $C_9$ |
| $C_5$ | $C_2$ | | | |
| $C_6$ | $C_1$ | $C_5$ | | |
| $C_7$ | $C_3$ | $C_4$ | | |
| $C_8$ | $C_2$ | $C_9$ | | |
| $C_9$ | $C_4$ | $C_8$ | | |

Each of the controllers is physically located at an intersection in a roadway system. The intersections are separated by roadway segments which are designated according to traffic flow patterns between intersections. For example, the roadway where traffic flows from $c_2$ to $c_1$ is designated $r_{c_2,c_1}$. The roadway segment where traffic flows from $c_1$ to $c_2$ is designated $r_{c_1,c_2}$. Likewise, traffic from on the roadway segment which carries traffic from $c_5$ to $c_2$ is designated $r_{c_5,c_2}$. Likewise, the roadway segment which carries traffic from $c_2$ to $c_5$ is designated $r_{c_2,c_5}$.

Figure 15:
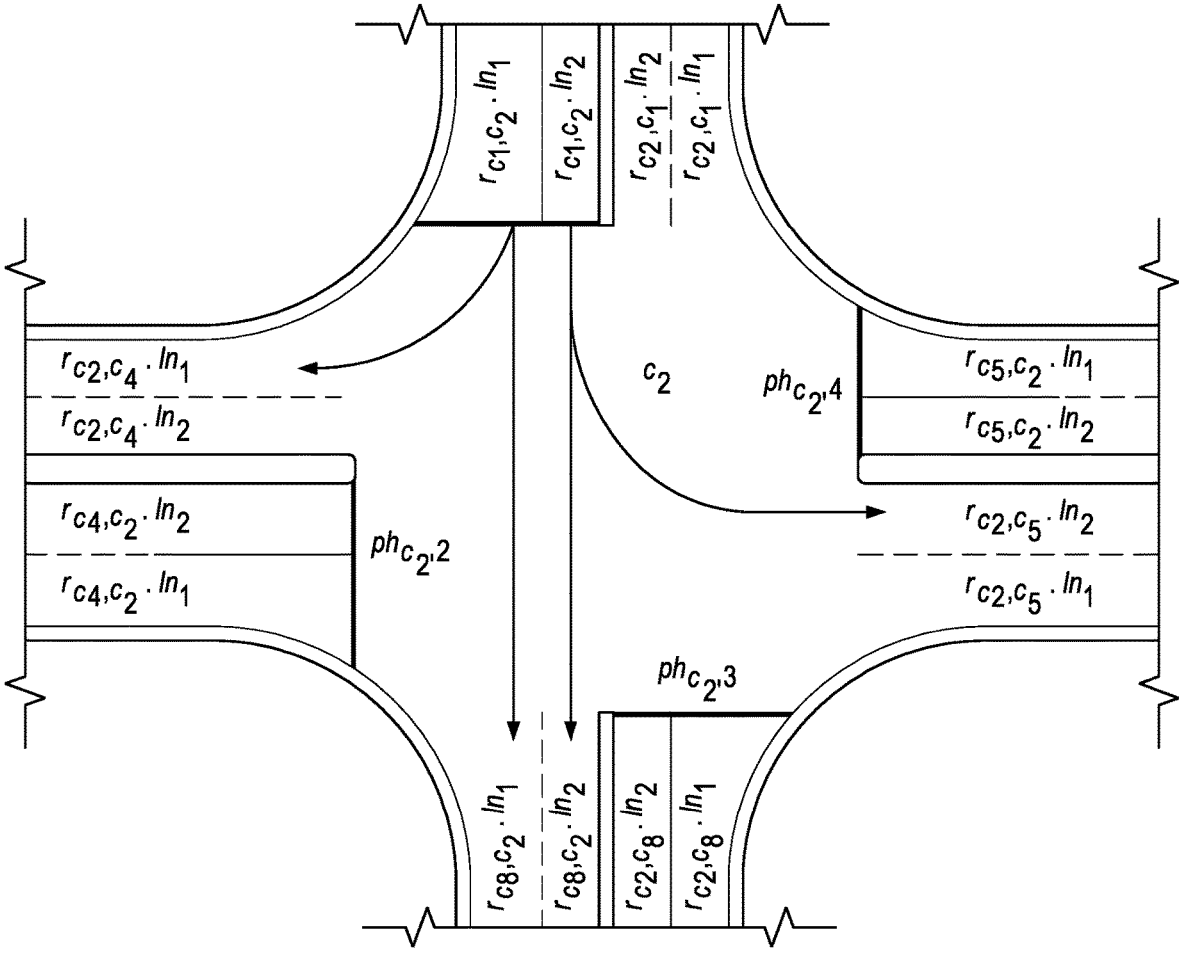
FIG. 15 is an example of a controller located at an intersection.

Referring to FIG. 15, an example of an intersection will be described. Lane and phase conventions are used to describe traffic flow at each intersection. Lanes are designated as ".$\ln_x$". The lanes are numbered from the outside to the inside. In this example, the outside lanes are labeled ".$\ln_1$" and the inside lanes are labeled .$\ln_2$.

Each controller is assigned a set of phases. ph designates phase, followed by the designation of the intersection and the designation of the phase. In this example, controller $c_2$ has four phases, $ph_{c_2,1}$, $ph_{c_2,2}$, $ph_{c_2,3}$ and $ph_{c_2,4}$ Set Definitions $T=\{t_1, \ldots, t_i\}$ is the set of time-stamps at which traffic conditions are evaluated.

$C=\{c_1, \ldots, c_n\}$ is the set of intersection controllers. An intersection controller $c_n$ is assigned a weight ω which corresponds to its priority in the road network.

$Rd=\{r_{c_1,c_2}, \ldots, r_{c_m,c_n}\}$ is the set of road segments between intersections. A road segment $r_{c_m,c_n}$ is defined in terms attributes such as length l, speed limit sl and a set of lanes $$LN_{r_{c_m,c_n}} = \{\ln_1 \ldots \ln_q\}$$

$$LT_{r_{c_m,c_n}.\ln_w}$$

is the set of lanes are accessible from $r_{c_m,c_n}.\ln_w$ $$LF_{r_{c_m,c_n}.\ln_w}$$

is the set of lanes that have access to $r_{c_m,c_n}.\ln_w$ $PH_{c_n}=\{ph_{c_n,1}, \ldots ph_{c_n,k}\}$ is the set of phases for the intersection controlled by $c_n$ A phase $ph_{c_n,k}$ is defined in terms of γ, the split time, v, the minimum green time, n, the maximum green time, ∈, the yellow time ξ, the red time and $$LN_{ph_{c_n,k}}$$

the set of lanes it applies to.

Function Definitions $p(r_{c_m,c_n}.\ln_w, r_{c_n,c_p}.\ln_u)$ is the probability that a vehicle exiting lane w in road segment $r_{c_m,c_n}$ enters lane u in road segment $r_{c_n,c_p}$. This probability is predefined based on historical data for the roadway segment and is stored in memory of the controller.

$p(r_{c_m,c_n}, r_{c_m,c_n}.\ln_w)$ is the probability that a vehicle which enters road segment $r_{c_m,c_n}$, leaves it from lane w. This probability is predefined based on historical data for the roadway segment and is stored in memory of the controller.

$rateOut(r_{c_m,c_n}.\ln_w)$ is the rate of vehicles (per second) that can leave the intersection through lane w of road segment $r_{c_m,c_n}$ within the current split time.

$rateIn(t_i, r_{c_m,c_n})$ is the rate of vehicles (per second) that enter road segment $r_{c_m,c_n}$ in the evaluation interval r that ends at time $t_i$.

$\xi t_i, r_{c_m,c_n}.\ln_w$ is the traffic throughput for lane $r_{c_m,c_n}.\ln_w$, i.e., the ratio of vehicles getting in and leaving the lane. It is defined as:

$$\xi_{t_i, r_{c_m,c_n}.\ln_w} = \frac{rateIn(t_i, r_{c_m,c_n}) \times p(r_{c_m,c_n}, r_{c_m,c_n} \cdot \ln_w)}{rateOut(t_i, r_{c_m,c_n} \cdot \ln_w)} \quad \text{Eq. 6}$$

Figure 16A:
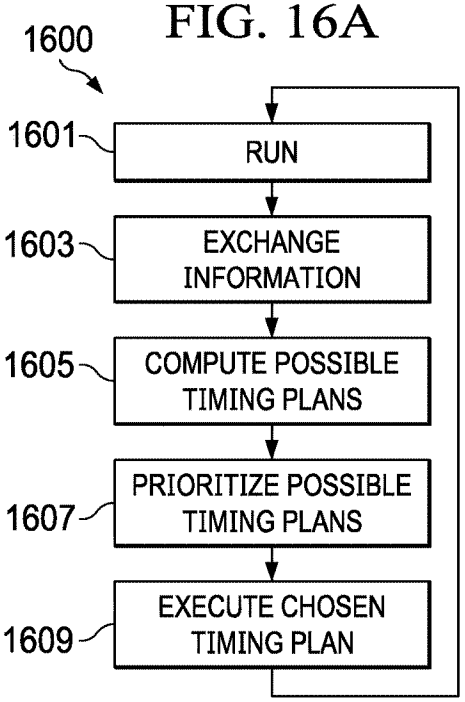
FIG. 16A is a flowchart of a preferred embodiment of an agent routine.

Referring to the FIG. 16A, plan generation and execution routine 1600 will be described. At step 1601, the controller is found in a steady state condition operating with a current plan of phase timing. At step 1603, the controller communicates with the other controllers to exchange traffic information.

Figure 16B:
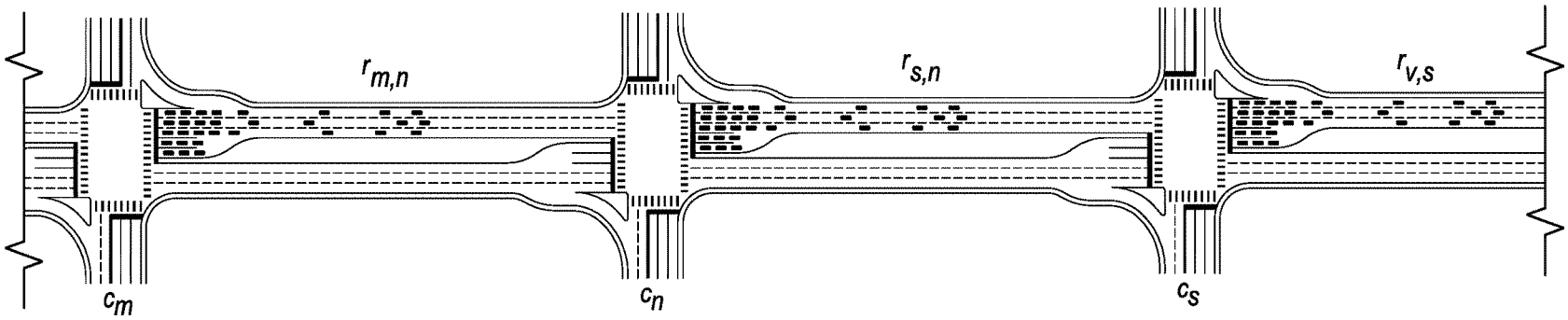
FIG. 16B is a traffic intersection network example.

Referring to FIG. 16B, an example of the exchange of traffic information between controllers will be described. Three consecutive unidirectional road segments $r_{v,s}$, $r_{s,n}$ and $r_{n,m}$ controlled respectively by controllers $c_s$, $c_n$ and $c_m$.

Controller $c_n$ exchanges two sets of information with controller $c_m$.

First, the number of vehicles detected by road segment $r_{s,n}$'s detector, and for each vehicle, its estimated arrival time at road segment's $r_{n,m}$ stop bar. The vehicle's estimated arrival time is computed based on p(□$r_{m,n}$,lnw,$r_{n,s}$)□, traffic flow rate ξ, and the distance along the roadway between the two stop bars.

Second, the anticipated number vehicles to arrive at $r_{s,n}$'s stop bar from s and from any other intersection preceding s (up to a maximum estimated arrival time of four minutes), and the estimated arrival time of these vehicles at $r_{n,m}$'s stop bar based on $c_n$'s current timing plan.

At step 1605, controller $c_m$ continuously defines possible timing plans based on the status of its phases, and timing constraints and configuration (e.g., minimum and maximum green, yellow and red clearance intervals). A timing plan includes a sequence of phase combinations as well as their splits and offsets.

At step 1607, given that the controllers goal is to find the values of the offset and split that minimize delay, for each timing plan, the controller computes the estimated delay using the phases' estimated queue lengths, estimated vehicle arrivals, location of user devices that will arrive at its intersection in the near future, the priority of user devices (i.e., $\omega_v$) and the value of probabilities. It then prioritizes the plans based on $\omega_v$ and minimum delay.

Figure 16C:
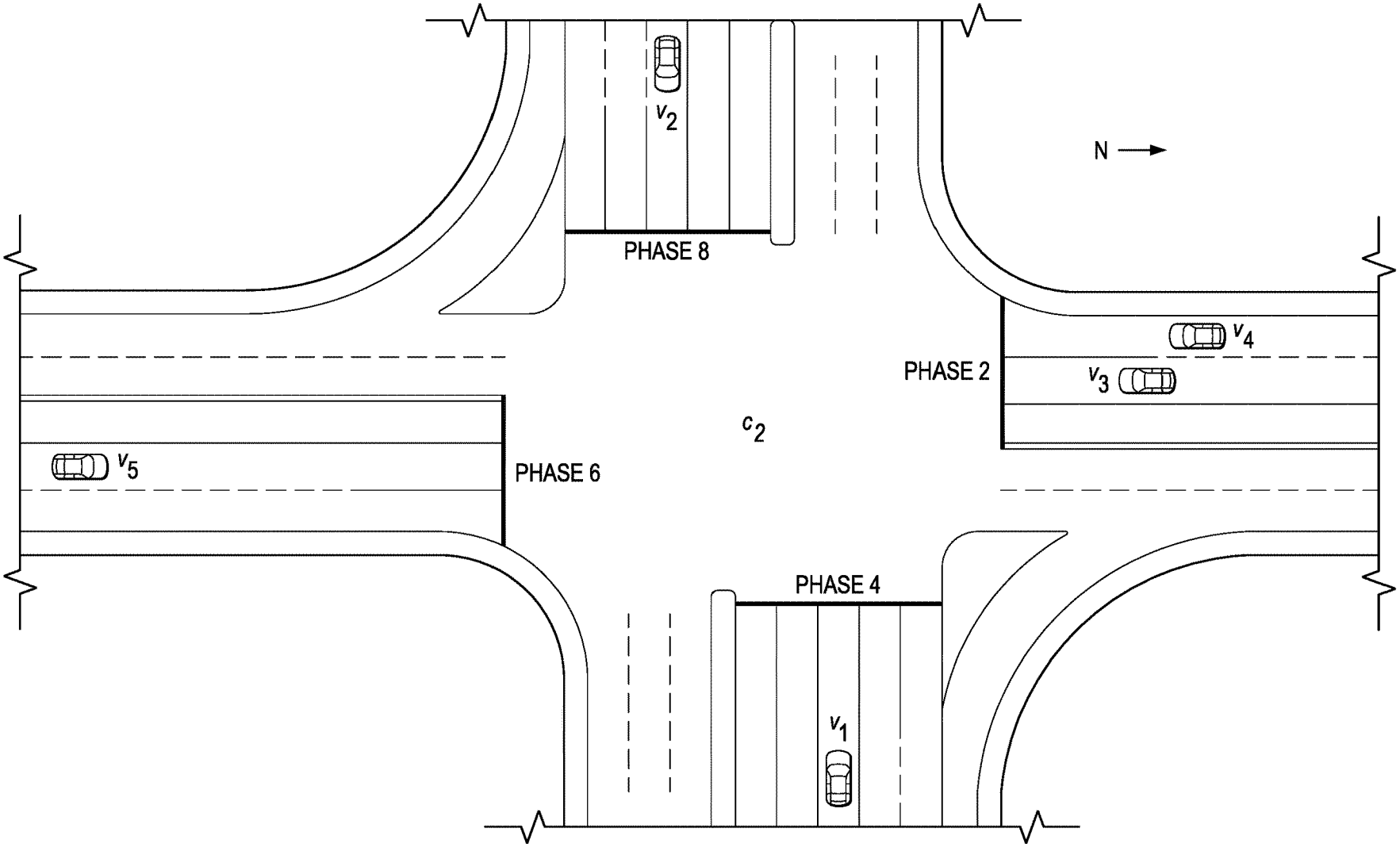
FIG. 16C is an example of a controller located at an intersection.

At step 1609, the controller executes the plan with the highest priority, and re-starts the process immediately Referring to FIG. 16C, an example of the definition and selection of timing plans by controllers, will be described. The intersection's phases, four and eight, are red, and, phases 2 and 6 are green. The assumption is that the estimated vehicle arrival times communicated to controller $c_n$ by adjacent controllers for vehicles $v_3$, $v_4$, $v_1$, $v_2$ and $v_5$ to be 2 s, 3 s, 6 s, 6 s and 9 s, respectively. The vehicle priorities $\omega_v$ for all vehicles are assumed to be the same. Controller $c_2$ first defines possible timing plans. In this example, the assumption is that there are only two possible timing plans: a) plan $pl_1$: keep phases two and six green for nine seconds and then switch to phases four and eight; b) plan $pl_2$: keep phases two and six green for the next three seconds; then, switch to phases four and eight and keep them green for four seconds; finally switch back to phases two and six. Controller $c_2$ then computes the estimated delay for each timing plan. The delay for a plan is the sum of the estimated delay for vehicles. Assume that the yellow interval is one second and there is no red clearance interval. For $pl_1$, given that $v_1$'s estimated arrival is 6 s, and phase four will become green after ten seconds, the estimated delay for $v_1$ is 10−6=4 seconds. The estimated delay for $v_2$, $v_3$, v4, and $v_5$ are 4 s, 0 s, 0 s and 0 s, respectively. Therefore, the estimated delay for plan $pl_1$ is eight seconds. With similar computations, the estimated delay for $pl_2$ is zero. Therefore, controller $c_n$ selects and executes $pl_2$.

Figure 17:
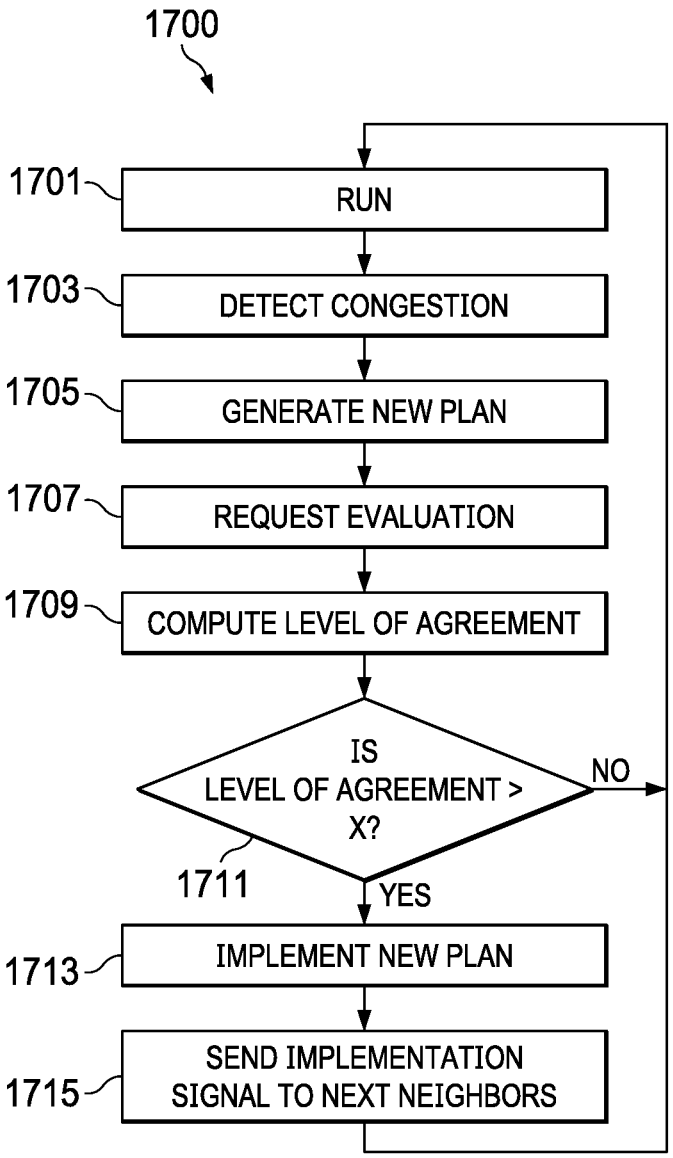
FIG. 17 is a flowchart of a preferred embodiment of an agent routine.

Referring to the FIG. 17, an alternate embodiment of a computation algorithm 1700 will be described.

At step 1701, the controller is in steady state condition, computes and executes timing plans, according to a current configuration of phase timing. The current configuration of phase timing includes an assignment of the green light time for each phase of traffic flow. The global configuration of phase timing also includes the current phase timing maps for each controller in the network. An identical copy of the global phase timing map is resident in memory of each controller on the network, and, if present on the network, each central server.

In steady state, intersection controller $c_n$ continuously evaluates the traffic flow to determine if a re-timing operation is necessary. At each $t_i$, $c_n$ receives rateIn and determines rateOut.

In one embodiment rateIn is detected through sensors at the controller. In another embodiment, rateIn is determined from sensors of each of the controllers nearest neighbor controllers. In either case, rateOut is determined by monitoring sensors local to the controller $c_n$.

At step 1703, at time $t_i$, controller $c_n$ computes congestion $$Cong_{t_i,ph_{c_n,k}}$$

as the average throughput for the set of lanes controlled by $ph_{c_n,k}$.

$$Cong_{t_i,ph_{c_n,k}} = \sum_{r_{c_m,c_n}.bi_w \in LN_{ph_{c_n,k}}} \xi_{t_i,r_{c_m,c_n}.bi_w} \quad \text{Eq. 7}$$

If $$Cong_{t_i,ph_{c_n,k}}$$

is greater than threshold a, then $c_n$ considers that there is an "instant congestion" and assigns the value of "1" to the variable InstantCongestion as follows:

$$InstantCongestion_{t_i,ph_{c_n,k}} \begin{cases} 1 & Cong_{t_i,ph_{c_n,k}} \geq a \\ 0 & Cong_{t_i,ph_{c_n,k}} < a \end{cases} \quad \text{Eq. 8}$$

$c_n$ then considers the past "b" evaluation cycles to determine the percentage of evaluation cycles in which the phase was congested. The past evaluation cycles are stored in local memory at the controller. Percentage congestion is defined as:

$$PercentCong_{t_i,ph_{c_n,k}} = \frac{\sum_{z=i-b}^{i} InstantCongestion_{t_i,ph_{c_n,k}}}{b} \times 100 \quad \text{Eq. 9}$$

If $$PercentCong_{t_i,ph_{c_n,k}} > d$$

then the road lanes controlled by $ph_{c_n,k}$ are considered to be congested.

The following pseudocode example illustrates a preferred embodiment of an algorithm used to determine congestion:

Algorithm 1: Controller Congestion Reduction

```
Require: PH_{c_n}, t_i
    1: for all ph_{c_n,k} ∈ PH_{c_n} do
    2:     EvaluateTraffic(ph_{c_n,k}, t_i: TotalInstCong)
    3:         if TotalInstCong / b > d then
    4:             GeneratePlan(ph_{c_n,k}, t_i: plan_new)
    5:             RequestForEvaluation(ph_{c_n,k}, t_i: plan_new Ψ_{c_n})
    6:             if Ψ_{c_n} > h then
    7:                 ExecutePlan(plan_new)
```

-continued

Algorithm 1: Controller Congestion Reduction

```
    end if
  end if
end for
If ReceiveRequestForEvaluation(c_p, κ_{r_{c_p,c_n}}, κ_{ph_{c_q,j}}) then
    ComputeLevelOfAgreement(κ_{r_{c_p,c_n}}, κ_{ph_{c_q,j}})
end if
if ReceiveRequestForExecution(c_p, plan_new) then
  AdjustTiming(plan_new)
end if
```

The following pseudocode example illustrates a preferred embodiment of an algorithm used to determine instant congestion.

Algorithm 2: Evaluate Traffic

```
Require: PH_{c_n}, t_i
for all ph_{c_n,k} ∈ PH_{c_n} do
  TotalInstCong ← 0
  for j = 0 to b do
    □ = 0
    for each r_{c_m,c_n} · ln_w ∈ LN_{ph_{c_n,k}} do
      □ ← ξt_i − j, r_{c_m,c_n} · ln_w + ?
    end for
    Cong_{t_i,ph_{c_n},k} ← ?
    if Cong_{t_i,ph_{c_n},k} ≥ a then
      TotalInstCong ← TotalInstCong + 1
      \* TotalInstCong Represent sum Over InstantCongestion
    end if
  end for
end for
```

At step 1705, the controller, generates a new phase configuration. To do so, $c_n$ deliberates to determine the value of a new split that will alleviate congestion on $ph_{c_n,k}$. The value of the new split is calculated as:

$$plan_{new} \cdot phase \cdot \gamma = plan_{cur} \cdot phase \cdot \gamma * \left( e + \frac{\sum_{z=i-v}^{i} Cong_{t_z,ph_{c_n,k}}}{v} * f \right) \quad \text{Eq. 10}$$

where e and f are coefficients that regulate the influence of the traffic throughput and the current split time. If $plan_{new}.phase.\gamma$ is greater than the maximum allowed split time $\gamma_{MAX}$, then its value is set to $ph_{c_n,\kappa}.\gamma_{MAX}$.

The following pseudocode example illustrates a preferred embodiment of an algorithm to generate a new phase timing configuration.

Algorithm 3: Generate Configuration

```
Require: PH_{c_n}, t_i
Ensure: plan_new
  plan_new · phase ← ph_{c_n,k}
  χ ← 0
  for j = i − v to i do
    χ ← χ + Cong_{t_i,ph_{c_n},k}
  end for
  χ ← χ / v
  plan_new · phase · γ ← plan_cur · phase · γ * (e + χ * f)
  if plan_new · phase · γ > ph_{c_n,k} · γ_MAX then
    plan_new · phase · γ ← ph_{c_n,k} · γ_MAX
  end if
```

At step 1707, the controller requests evaluation from each of its next neighbor controllers.

$c_n$ determines the impact of executing the new configuration on the neighboring intersections in terms of κ, the increment in vehicle rate.

$$\kappa_{r_{c_m,c_n} \cdot ln_w}$$

is calculated for road time $r_{c_m,c_n}.ln_w$ as:

$$\kappa_{r_{c_m,c_n} \cdot ln_w} = \frac{rateOut(t_i, r_{c_m,c_n} \cdot ln_w) \times (plan_{new} \cdot phase \cdot \gamma - plan_{cur} \cdot phase \cdot \gamma)}{plan_{new} \cdot phase \cdot \gamma} \quad \text{Eq. 11}$$

$$\kappa_{ph_{c_n,k}}$$

for a phase $ph_{c_n,k}$ is defined as the sum of $$\kappa_{r_{c_m,c_n} \cdot ln_w}$$

for the rest of lanes controlled by the phase. In the same way, $$\kappa_{r_{c_n,c_p}}$$

for a road segment $r_{c_n,c_p}$, is the sum of $$\kappa_{r_{c_n,c_p} \cdot ln_w}.$$

Controller $c_n$ proceeds by sending $plan_{new}$, $r_{c_n,c_p}$ and $$plan_{new},\ r_{c_n,c_p} \text{ and } \kappa_{ph_{c_n,k}}$$

to each adjacent controller $c_p$ for evaluation.

The following pseudocode is an example of an algorithm of a preferred embodiment of a request made by controller $c_n$ to its next neighbor controllers.

Algorithm 4: Request for Evaluation

Require: $PH_{c_n,k}$, $plan_{new}$
Ensure: $\Psi_{c_n}$

1: $\kappa_{ph_{c_n,\kappa}} \leftarrow 0$

2: for each $r_{c_m,c_n} \cdot ln_w$ in $LN_{ph_{c_n,k}}$ do

3: $\kappa_{ph_{c_n,\kappa}} \leftarrow \kappa_{ph_{c_n,\kappa}} + \kappa_{r_{c_m,c_n} \cdot ln_w}$ 4: end for
5: $\Psi_{c_n} \leftarrow 0$
6: for each accessible neighbor $c_p$, in parallel do 7: $\kappa_{r_{c_n,c_p}} \leftarrow 0$ 8: for $r_{c_m,c_n} \cdot ln_w \in LN_{ph_{c_n,k}}$ do 9: for $r_{c_n,c_p} \cdot ln_u \in LT_{r_{c_m,c_n} \cdot ln_w}$ do 10 $\kappa_{r_{c_n,c_p}} \leftarrow \kappa_{r_{c_n,c_p}} + \left(p\left(r_{c_m,c_n} \cdot ln_w, r_{c_n,c_p} \cdot ln_u\right) \times \kappa_{r_{c_m,c_n} \cdot ln_w}\right)$ 11: end for
12: end for 13: $\mathrm{Send}\left(c_p, \kappa_{r_{c_n,c_p}}, \kappa_{ph_{c_n,k}}\right)$ 14: Receive($c_p$, $\Psi_{c_p}$)
15: $\Psi_{c_n} \leftarrow \Psi_{c_n} + \Psi_{c_p}$
16: end for At step 1709, the controller computes the level of agreement between all controllers.

Upon receipt of a new configuration, $c_n$'s neighboring controller $c_p$ computes $r_{c_p,c_q}$ for each of its neighbor controllers $c_q$ and requests that they each evaluate the configuration. The process propagates until at a given intersection, either the value of κ is smaller than a predetermined threshold g or the configuration reaches the road network boundaries. Following this step and recursively, each controller sends back its level of agreement in terms of a real number Ψ, to the controller from which it has received the request. An intermediate controller, $c_p$, calculates $\Psi_{c_p}$ based on the existing traffic throughput, its priority, c, its assigned vehicle priority $\omega_v$, and the ratio of the received additional vehicle throughput.

At step 1711, the controller decides whether or not the level of agreement is greater or less than a preset value. After receiving the level of agreement from all affected neighbors, $c_p$ combines them with its own level of agreement $\Psi_{c_p}$ and sends the value back to $c_n$. The final decision is made based on the value of $\Omega_{c_n}$ representing the feedback of all involved controllers. The following equation is used:

$$A = \sum_{i=1}^{n} (\omega_c)(\omega_v)\Psi_i \qquad \text{Eq. 12}$$

$$\text{where} \begin{cases} A \geq 0 = Agrement \\ A < 0 = \text{Disagreement} \end{cases} \qquad \text{Eq. 13}$$

If the value of Ψ, exceeds a predetermined value of x, then the controller proceeds to step 1713. If not, then the controller returns to step 1701.

At step 1713, the controller implements the new configuration.

At step 1715, the controller sends an implementation signal to each of its next neighbor controllers to implement the new configuration.

The controller then returns to step 1601 and enters a steady state run condition.

Figure 18:
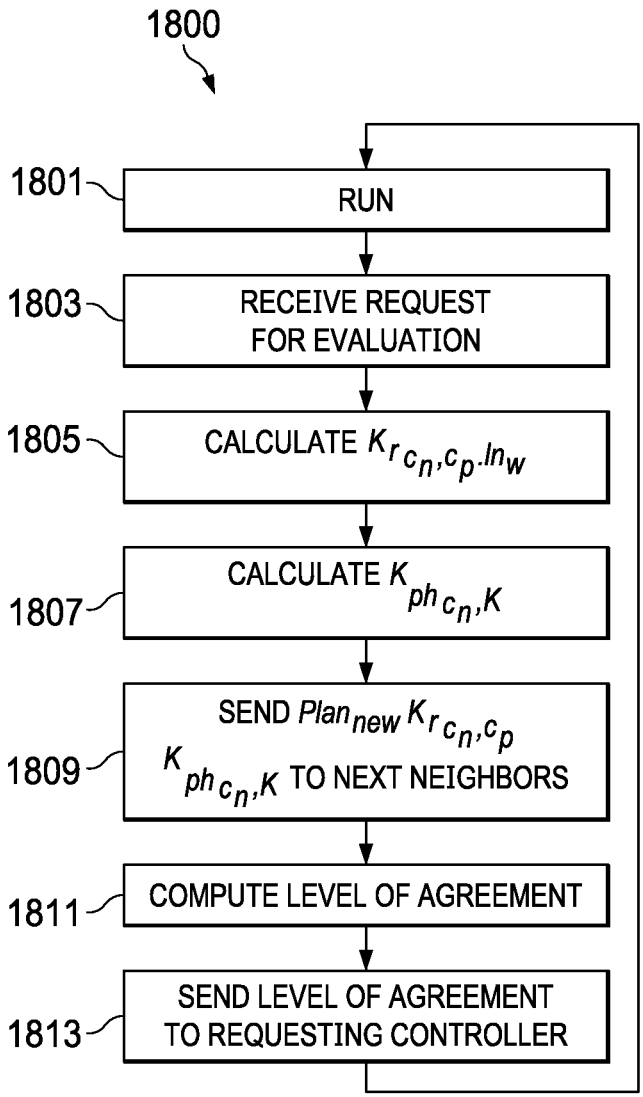
FIG. 18 is a flowchart of a preferred embodiment of an agent routine.

Referring then to FIG. 18, evaluation algorithm 1800 will be described.

At step 1801, the controller is found in a steady state run condition.

At step 1803, the controller receives a request for evaluation of a new configuration from a next neighbor controller.

At step 1805, the controller calculates $$\kappa_{r_{c_n,c_p} \cdot ln_w},$$

as previously described.

At step 1807, the controller calculates $$\kappa_{ph_{c_n,\kappa}},$$

as previously described.

At step 1809, the controller sends the new configuration, and the values of $$\kappa_{r_{c_n,c_p}} \text{ and } \kappa_{ph_{c_n,\kappa}}$$

to each of its next neighbor controllers.

At step 1811, controller computes a level of agreement as previously described.

At step 1813, the controller sends the level of agreement calculated to the requesting controller.

The controller then returns to the steady state run condition at step 1801.

Referring again to FIG. 14 and FIG. 15, a practical example of an implementation of the algorithms of a preferred embodiment of the system for controller $c_2$, will be described.

$C_2$ has four incoming roads, each with two lanes. Referring to FIG. 15, the four phases of $c_2$'s intersection are $ph_{c_2,1}$, $ph_{c_2,2}$, $ph_{c_2,3}$, $ph_{c_2,4}$. These phases apply as follows:

$ph_{c_2,1}$ for $r_{c_1,c_2}$
$ph_{c_2,2}$ for $r_{c_4,c_2}$
$ph_{c_2,3}$ for $r_{c_8,c_2}$
$ph_{c_2,4}$ for $r_{c_5,c_2}$ The phases have the following example attribute values.

γ=40
v=20
n=60
∈=5
ξ=5 where:

γ is the split time
v is the minimum green
n is the maximum green
∈ is the yellow change interval
ξ is the red clearance interval The following constants have been used in this example.

a=1
b=50 d=80 e=1 f=0.2

In this example, to determine whether or not a congestion condition occurs, $c_2$ evaluates the status of its intersection at the time stamp $t_{6000}$. It starts with phase, $ph_{c_2,1}$ and calculates the average traffic throughput $Cong_{6000,ph_{c2,1}}$ for the set of road lanes that $ph_{c_2,1}$ controls. Given that rateOut($t_{6000}$, $r_{c_1,c_2}.ln_1$)=1, p($r_{c_1,c_2}$,$r_{c_1,c_2}.ln_1$=0.8 and rateIn($t_{6000}$,$r_{c_1,c_2}$)=2.4, the value of $$\xi_{t_{6000},r_{c_1,c_2}.ln_1}$$

is $$\xi_{t_{6000},r_{c_1,c_2}.ln_1} = \frac{2.4\times 0.8}{1} = 1.92 \quad \text{Eq. 14}$$

For the sake of illustration, assume that $$Cong_{t_{6000},ph_{c_2,1}} = 1.31,$$

which is greater than the threshold a=1. $c_2$ then retrieves the calculated values of Cong between the time stamps $t_{5950}$ and $t_{5999}$. In this example, 43 of them are greater than a. Therefore, $$PercentCong_{t_{6000},ph_{c_2,1}} = \frac{43}{50}\times 100 > 80 \quad \text{Eq. 15}$$

Consequently, $c_2$ detects a congestion condition on phase $ph_{c_2,1}$ and deliberates to define a new configuration.

To generate a new configuration, the controller deliberates to determine the value of a new split that will alleviate congestion on $ph_{c_n,k}$, as shown in exemplary steps 7 and 9 of Algorithm 3. e and f are calibration coefficients that are predetermined and stored in memory. The coefficients e and f regulate the influence of the traffic throughput and the current split time for the new split time. They can be calibrated over time to achieve peak efficiency. Values of cycle length and offset change in the new split.

In this example, the value of the new split is calculated as the average of Cong for phase $ph_{c_2,1}$, in the last v=20 evaluation cycles is 1.23. Given that e=1 and f=0.2, $c_2$ defines a new configuration for $ph_{c_2,1}$, and computes $plan_{new}$.phase.γ as:

$$plan_{new}.phase.\gamma=40\times(1+1.23\times 0.2)\approx 18 \quad \text{Eq. 16}$$

Therefore, $c_2$ determines that it needs to increase $ph_{c_2,1}.\gamma$ by about 18 seconds.

To determine the impact of executing the new configuration on the neighboring intersections controller $c_2$ requests an evaluation in terms of κ, the increment in vehicle rate.

$$\kappa_{r_{c_m,c_n}.ln_w}$$

is determined as the increment in vehicle rate for a roadway $$\kappa_{ph_{c_n,k}}$$

is defined as the increment in vehicle rate for the phase.

$$\kappa_{ph_{c_n,k}}$$

for a phase $ph_{c_n,k}$ is further defined as the sum of $$\kappa_{r_{c_m,c_n}.ln_w}$$

for the set of lanes controlled by the phase (Algorithm 4, Step 3). In the same way, $$\kappa_{r_{c_n,c_p}}$$

for a road segment $r_{c_n,c_p}$, is further defined as the sum of $$\kappa_{r_{c_n,c_p}.ln_w}$$

(algorithm 4, step 10). Controller $c_n$ proceeds by sending $plan_{new}$, $$\kappa_{r_{c_n,c_p}} \text{ and } \kappa_{ph_{c_n,k}}$$

to each adjacent controller $c_p$ for evaluation.

$$\kappa_{ph_{c_n,k}}$$

corresponds to the increment in the rate of vehicles that exit the road lanes controlled by $ph_{c_n,k}$, in case the new configuration is to be executed.

$$\kappa_{r_{c_n,c_p}}$$

corresponds to the portion of $$\kappa_{ph_{c_n,k}}$$

that goes to road segment $r_{c_n,c_p}$. in the illustrative example, $c_2$ calculates $$\kappa_{r_{c_1,c_2}.ln_1}$$

as:

$$\kappa_{r_{c_1,c_2}.ln_1} = \frac{1 \times (50 - 40)}{50} = 0.25 \quad \text{Eq. 17}$$

Having $$\kappa_{r_{c_1,c_2}.ln_2} = 0.3, \kappa_{ph_{c_2,1}}$$

takes the value of 0.55. $c_2$ then calculates the effect of executing a new configuration on its neighboring intersections, such as the intersection controller by controller $c_4$. Assuming $p(r_{c_1,c_2}.ln_1, r_{c_2,c_4}.ln_1)=0.7$, $p(r_{c_1,c_2}.ln_1, r_{c_2,c_4}.ln_2)=0$, $p(r_{c_1,c_2}.ln_2, r_{c_2,c_4}.ln_1)=0.2$ and $p(r_{c_1,c_2}.ln_2, r_{c_2,c_4}.ln_2)=0$, $\kappa_{r_{c2,c4}}$ will be calculated as:

$$\kappa_{r_{c_2,c_4}} = 0.25 \times 0.7 + 0.25 \times 0 + 0.3 \times 0.2 + 0.3 \times 0 = 0.32 \quad \text{Eq. 18}$$

$c_2$ then sends a request for evaluation to $c_4$ with $$\kappa_{r_{c_2,c_4}} = 0.32 \text{ and } \kappa_{ph_{c_2,1}} = 0.55.$$

This means that by executing $plan_{new}$, an additional 0.55 vehicle per seconds (vps) will leave $ph_{c_2,1}$, and out of the 0.55 (vps), 0.32 (vps) will enter $r_{c_2,c_4}$.

Upon receipt of a new configuration, $c_n$'s neighboring controller $c_p$ computes $$\kappa_{r_{c_p,c_q}}$$

for each of its neighbor controllers $c_q$ and requests that they each evaluate the configuration. The process propagates until at a given intersection, either the value of k is smaller than predetermined threshold g which is the propagation scope coefficient, or the configuration reaches the road network boundaries. Each of the controllers on the network then sends its level of agreement in terms of a real number $\Psi$, to the controller from which it has received the request. All other controllers, like, for example, controller, $c_p$, calculates $\Psi_{c_p}$ based on the existing traffic throughput. Its priority $\omega$, its vehicle priority $\omega_v$, and the ratio of the received additional vehicle throughput, x, y and z are coefficients that calibrate the influence of variables in $\Psi_{c_n}$ representing the opinion of all affected controllers in the network.

$\omega_c$ is a predetermined priority variable for each of the controllers, stored in local memory. It can be used to change the immediate timing of any intersection based on an external request by a user device or a server. In general, $\omega_c$ is used to adjust the timing of lights at heavy traffic intersections. Likewise, the vehicle priority, $\omega_v$, is used as an interface parameter with embodiments that include servers and user devices that present transportation modes to prioritize traffic flow.

In the illustrative example, given that $rateOut(t_{6000}, r_{c_2,c_4}.ln_1)=1$, $rateOut(t_{6000}, r_{c_2,c_4}.ln_2)=0.3$, $rateIn(t_{6000}, r_{c_2,c_4})=1.2$, $p(r_{c_2,c_4}, r_{c_2,c_4}.ln_1)=0.8$ and $p(r_{c_2,c_4}, r_{c_2,c_4}.ln_2)=0.2$, the value of $\Psi_{c_4}$ is calculated as:

$$\Psi_{c_4} = 1.0 \times 2.0 \times \frac{0.32}{0.55} \times \left(\left(1 - 1 \times \frac{(0.32 + 1.2) \times 0.8}{1}\right) + \left(1 - 1 \times \frac{(0.32 + 1.2) \times 0.2}{0.3}\right)\right) = -.02 \quad \text{Eq. 19}$$

$c_4$ calculates k for $c_3$, $c_7$ and $c_9$ and ask them to evaluate the configuration if k is greater than threshold g. The result is added to $\Psi_{c_4}$ and sent back to $c_2$. Upon receipt of $\Psi_{c_4}$, $\Psi_{c_5}$ and $\Psi_{c_8}$, controller $c_2$ calculates $\Psi_{c_2}$. By adding all the values of $\Psi$ received plus its own value of $\Psi$. Given that h is the decision-making threshold is h=0, total negative values of $\Psi$ are considered as a level of disagreement (Algorithm 1, Step 6) while total positive values of $\Psi$ are considered a level of agreement. Having $\Psi_{c_2}=2.34$, $c_2$ executes the new configuration and announces the execution to all controllers in the network. Each of the controllers then implements the new configuration.

Experimental Results

Experiments of a preferred embodiment of the system were run on a multicore PC (Intel Core i7 X980 CPU (3.33 GHz), 6.00 GB, 64-bit Windows 7). A simulated model of a road network of Richardson, Tex. was created in MATISSE. The model includes 1365 road segments, 128 signalized intersections and 965 non-signalized intersections. Tables 1 and 2 summarize the types of signalized and non-signalized intersections, classified based on the number of incoming and outgoing lanes.

Number of Signalized Intersection with Various Incoming and Outgoing Lanes

TABLE 3

| | Type | | | | | |
|---|---|---|---|---|---|---|
| | 1 × 1 | 1 × 2 | 1 × 3 | 2 × 2 | 2 × 3 | 3 × 3 |
| Count | 0 | 4 | 8 | 18 | 29 | 69 |

Number of Non-Signalized Intersection with Various Incoming and Outgoing Lanes

TABLE 4

| | Type | | | | | |
|---|---|---|---|---|---|---|
| | 1 × 1 | 1 × 2 | 1 × 3 | 2 × 2 | 2 × 3 | 3 × 3 |
| Count | 533 | 241 | 175 | 16 | 0 | 0 |

Three simulation settings were run eight times for 86,400 simulation cycles representing a 24-hour time period. The average delay for all vehicles was measured. In the first and second experiments, real-world data provided by the City of Richardson was used to simulate regular traffic patterns with and without accidents. In the third and fourth experiments, simulated continuous random traffic patterns with and without accidents was used. For all experiments, comparing the efficiency of DALI with the SCATS-based system currently in use in Richardson (SCATS-R), and a model of the RL-based MARLIN-ATSC [15] (MARLIN-R). To decrease the learning time of MARLIN agents, initialization of the Q-values based on estimations derived from historical data as provided by the City of Richardson.

Experiment 1: Normal Traffic Conditions

In this experiment, use of the traffic data provided by the City of Richardson to determine the number of vehicles in the traffic network at any given time, as well as their distribution in the network. This experiment is intended to analyze the behavior of the three systems under nominal traffic conditions.

Figure 19:
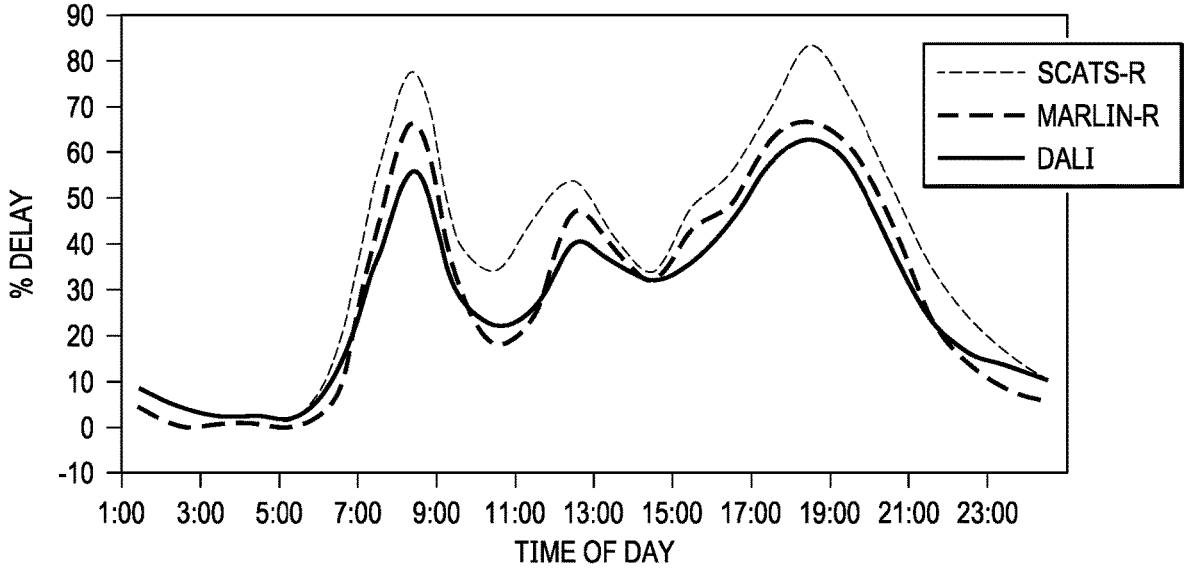
FIG. 19 is a graph of experimental data related to improved average delay time in an intersection resulting from implementation of a preferred embodiment.

As shown in FIG. 19, between the times of 00:30 am and 5:30 am DALI and SCATS-R perform at the same level with respect to delay. This is due to the fact that during this time period, traffic is very light and therefore DALI agents do not perform any action. MARLIN-R agents perform better (53% delay reduction) in this situation because of their flexibility in changing the traffic phases at any time. As we progress during the day (i.e., 6:30 am to 8:30 am) the traffic flow increases, and congestion is detected. DALI agents naturally collaborate with one another to define and implement timing configurations that meet the network conditions. As such, DALI performs significantly better than SCATS-R (23% delay reduction). MARLIN-R performs slightly less than DALI. The simulation shows that this is due to the fact that MARLIN-R agents do not handle heavy traffic in small network areas with a large number of intersections efficiently. In those cases, MARLIN-R agents give the right-of-way to vehicles without taking into account the downstream roads which are congested.

Experiment 2: Normal Traffic Conditions with Accident

Figure 20:
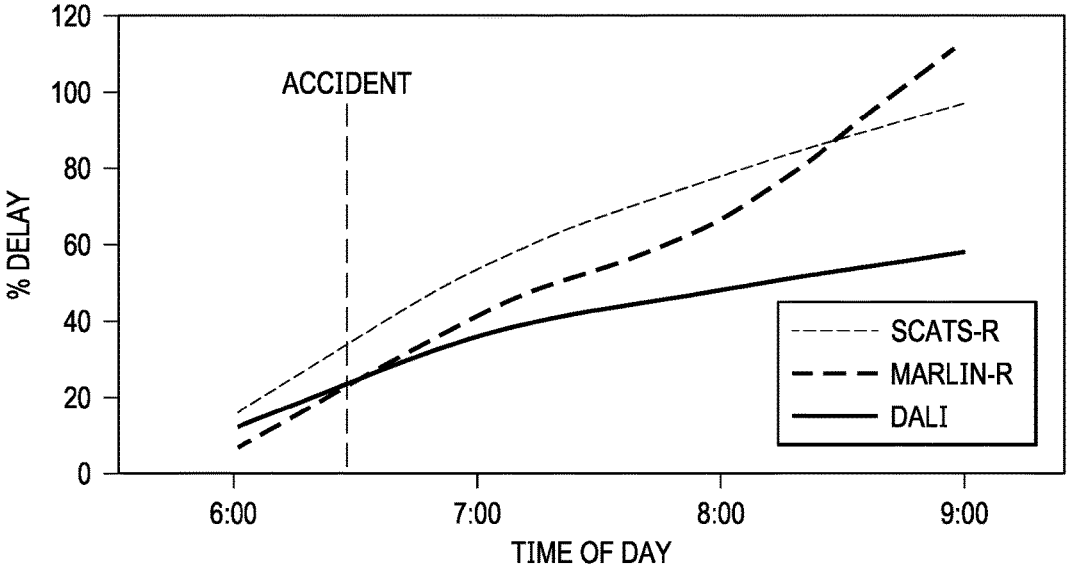
FIG. 20 is a graph of experimental data related to improved average delay time in an intersection resulting from implementation a preferred embodiment.

FIG. 20 shows the performance of the systems when an accident is triggered at run time, during normal morning peak traffic. As expected, DALI handles the traffic much better than SCATS-R (35% delay reduction). It is notable that MARLIN-R agents are unable to control the congestion created by the accident since they have no prior knowledge of the unexpected traffic pattern. Similar to Experiment 1, the simulation shows that, rather than leading the vehicles towards roads with lighter traffic, MARLIN-R agents send vehicles to congested areas.

The invention claimed is:

1. A system for operating a set of traffic lights at an intersection comprising:

a first controller having a first memory, operatively connected to the set of traffic lights;

a second controller, having a second memory, operatively connected to the first controller;

a set of instructions resident in the first memory and the second memory, that when executed, cause the system to:

detect a congestion condition at the intersection;

generate a phase plan for the set of traffic lights based on the congestion condition;

send a request for evaluation of the phase plan from the first controller to the second controller;

derive a first evaluation of the phase plan at the second controller;

send the first evaluation from the second controller to the first controller;

compute a level of agreement based on the first evaluation;

compare the level of agreement to a first predetermined standard;

implement the phase plan if the level of agreement meets the first predefined standard; and, reject the phase plan if the level of agreement does not meet the first predetermined standard.

2. The system of claim 1 wherein deriving an evaluation further comprises:

calculating an increment in a road lane vehicle rate; and, calculating an increment in a phase vehicle rate.

3. The system of claim 2 wherein:

the increment in the road lane vehicle rate is based on a rate of vehicles exiting the intersection; and, the phase plan.

4. The system of claim 1 wherein the step of determining a congestion condition further comprises:

computing a congestion value based on an average vehicle throughput for a set of lanes of the intersection and a set of phases of the set of traffic lights;

determining an instant congestion value; and, determining a percentage congestion for the intersection for a predetermined set of evaluation cycles.

5. The system of claim 1 wherein generating a phase plan further comprises:

determining a phase split for each phase of the phase plan based on the congestion value and a minimum allowed green time for the set of traffic lights.

6. The system of claim 1 wherein determining a level of agreement further comprises:

deriving a second evaluation of the phase plan at the first controller;

aggregating the first evaluation and the second evaluation to derive a feedback value;

deriving a feedback comparison value based on the feedback value a second predetermined standard; and, determining an agreement based on the feedback comparison value.

* * * * *